US010373464B2

(12) United States Patent
Wilkinson et al.

(10) Patent No.: US 10,373,464 B2
(45) **Date of Patent: *Aug. 6, 2019**

(54) APPARATUS AND METHOD FOR UPDATING PARTIALITY VECTORS BASED ON MONITORING OF PERSON AND HIS OR HER HOME

(71) Applicant: Walmart Apollo, LLC, Bentonville, AR (US)

(72) Inventors: Bruce W. Wilkinson, Rogers, AR (US); Todd D. Mattingly, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/947,380

(22) Filed: Apr. 6, 2018

(65) Prior Publication Data

US 2018/0233014 A1 Aug. 16, 2018

Related U.S. Application Data

(63) Continuation-in-part of application No. 15/642,738, filed on Jul. 6, 2017, now Pat. No. 10,169,971.

(Continued)

(51) Int. Cl.

| | |
|---|---|
| ***G08B 21/02*** | (2006.01) |
| ***G08B 21/04*** | (2006.01) |
| ***G08B 25/08*** | (2006.01) |

(52) U.S. Cl.

CPC ..... *G08B 21/02* (2013.01); *G08B 21/0484* (2013.01); *G08B 25/08* (2013.01)

(58) Field of Classification Search

CPC ..... G08B 21/02

(Continued)

(56) References Cited

U.S. PATENT DOCUMENTS

| | | | |
|---|---|---|---|
| 4,771,380 | A | 9/1988 | Kriz |
| 4,931,929 | A | 6/1990 | Sherman |

(Continued)

FOREIGN PATENT DOCUMENTS

| | | |
|---|---|---|
| CA | 2822865 | 2/2014 |
| CN | 103106267 | 5/2013 |

(Continued)

OTHER PUBLICATIONS

Jakkula, V. et al.; "Detecting Anomalous Sensor Events in Smart Home Data for Enhancing the Living Experience"; Proceedings AAIWS'11-07 Proceedings of the 7th AAAI Conference on Artificial Intelligence and Smarter Living: The Conquest of Complexity; pp. 33-37.

(Continued)

*Primary Examiner* — Jack K Wang

(74) *Attorney, Agent, or Firm* — Fitch, Even, Tabin & Flannery LLP

(57) ABSTRACT

In some embodiments, apparatuses, systems, and methods are provided herein useful to detecting a deviation in a person's activity. In some embodiments, an apparatus comprises one or more sensors, the one or more sensors configured to monitor parameters associated with a person and the person's home, and a control circuit, the control circuit communicatively coupled to the one or more sensors and configured to generate one or more partiality vectors for the person, receive, from the one or more sensors, values associated with the parameters, create, based on the values associated with the parameters, a spectral profile for the person, determine, based on the spectral profile and a routine base state for the person, that a combination of the values indicates a deviation, and update at least one of the one or more partiality vectors for the person.

20 Claims, 18 Drawing Sheets

Related U.S. Application Data

(60) Provisional application No. 62/359,462, filed on Jul. 7, 2016, provisional application No. 62/485,045, filed on Apr. 13, 2017.

(58) Field of Classification Search
USPC ..... 340/573.1
See application file for complete search history.

(56) References Cited

U.S. PATENT DOCUMENTS 5,092,343 A 3/1992 Spitzer
5,357,439 A 10/1994 Matsuzaki
5,410,471 A 4/1995 Alyfuku
5,712,830 A 1/1998 Ross
5,737,611 A 4/1998 Vicik
5,974,396 A 10/1999 Anderson
6,236,974 B1 5/2001 Kolawa
6,249,773 B1 6/2001 Allard
6,260,024 B1 7/2001 Shkedy
6,327,574 B1 12/2001 Kramer
6,519,571 B1 2/2003 Guheen
6,583,720 B1 6/2003 Quigley
6,594,642 B1 7/2003 Lemchen
6,614,348 B2 9/2003 Ciccolo
6,615,208 B1 9/2003 Behrens
6,654,725 B1 11/2003 Langheinrich
6,731,940 B1 5/2004 Nagendran
6,826,541 B1 11/2004 Johnston
6,856,249 B2 2/2005 Strubbe
6,901,304 B2 5/2005 Swan
6,937,710 B1 8/2005 Griffiths
7,063,263 B2 6/2006 Swartz
7,072,848 B2 7/2006 Boyd
7,130,814 B1 10/2006 Szabo
7,147,154 B2 12/2006 Myers
7,174,312 B2 2/2007 Harper
7,225,979 B2 6/2007 Silverbrook
7,249,708 B2 7/2007 McConnell
7,330,828 B2 2/2008 Schoder
7,346,563 B2 3/2008 Pellerin
7,369,680 B2 5/2008 Trajkovic
7,508,307 B2 3/2009 Albert
7,584,139 B2 9/2009 Goodwin
7,657,457 B2 2/2010 Razumov
7,658,327 B2 2/2010 Tuchman
7,680,694 B2 3/2010 Glazer
7,685,024 B2 3/2010 Ofer
7,707,073 B2 4/2010 Bloebaum
7,720,720 B1 5/2010 Sharma
7,766,829 B2 8/2010 Sloan
7,778,773 B2 8/2010 Yaqub
7,814,029 B1 10/2010 Siegel
7,819,315 B1 10/2010 Pienkos
7,856,368 B2 12/2010 Avallone
7,860,759 B2 12/2010 Stoppelman
7,873,543 B2 1/2011 Perrier
7,945,473 B2 5/2011 Fano
8,013,729 B2 9/2011 Buehler
8,036,951 B2 10/2011 Kraft
8,055,546 B1 11/2011 Cassone
8,073,460 B1 12/2011 Scofield
8,086,546 B2 12/2011 Spiegel
8,117,089 B2 2/2012 Minsky
8,140,388 B2 3/2012 Gross
8,244,830 B2 8/2012 Robinson
8,249,946 B2 8/2012 Froseth
8,261,306 B2 9/2012 Dimitrova
8,266,017 B1 9/2012 Dearlove
8,271,322 B2 9/2012 Ariyibi
8,285,715 B2 10/2012 Faria
8,316,020 B1 11/2012 Kleinmann
8,364,520 B1 1/2013 Eichorn
8,370,207 B2 2/2013 Edwards
8,370,216 B2 2/2013 Kessel
8,386,285 B2 2/2013 Chen
8,401,914 B1 3/2013 Kim
8,429,026 B1 4/2013 Kolawa
8,447,703 B2 5/2013 Yuasa
8,457,354 B1 6/2013 Kolar
8,494,915 B2 7/2013 Mesaros
8,538,829 B1 9/2013 Hu
8,558,703 B2 10/2013 Edlund
8,577,753 B1 11/2013 Vincent
8,583,511 B2 11/2013 Hendrickson
8,595,773 B1 11/2013 Wang
8,606,636 B1 12/2013 Keoshkerian
8,606,645 B1 12/2013 Applefeld
8,630,921 B2 1/2014 Nuzzi
8,666,844 B2 3/2014 Shaya
8,738,541 B2 5/2014 Gross
8,744,920 B2 6/2014 Aldomar
8,803,366 B2 8/2014 Proud
8,818,876 B2 8/2014 Yu
8,849,719 B2 9/2014 Baker
8,874,485 B2 10/2014 Partridge
8,968,195 B2 3/2015 Tran
9,015,277 B1 4/2015 Slavin
9,030,295 B2 5/2015 Allen
9,036,019 B2 5/2015 Hanson
9,087,358 B1 7/2015 Giorgalli
9,129,250 B1 9/2015 Sestini
9,165,320 B1 10/2015 Belvin
9,174,758 B1 11/2015 Rowley
9,183,510 B1 11/2015 Walti
9,189,021 B2 11/2015 Jerauld
9,218,633 B2 12/2015 Hulett
9,224,157 B2 12/2015 Lim
9,230,070 B2 1/2016 Farha
9,251,527 B2 2/2016 Shah
9,256,693 B2 2/2016 Nice
9,256,890 B1 2/2016 Schmidt
9,286,617 B2 3/2016 Maskatia
9,294,298 B2 3/2016 Lee
9,325,849 B1 4/2016 Brydon
9,424,589 B2 8/2016 Perrier
9,451,576 B2 9/2016 Lifshitz
9,489,674 B2 11/2016 Faith
9,750,439 B2 9/2017 Doniger
2001/0014868 A1 8/2001 Herz
2001/0034661 A1 10/2001 Ferreira
2002/0003166 A1 1/2002 Miller
2002/0010000 A1 1/2002 Chern
2002/0052825 A1 5/2002 Bensemana
2002/0095345 A1 7/2002 Panelli
2002/0128910 A1 9/2002 Sakuma
2002/0152001 A1 10/2002 Knipp
2002/0161664 A1 10/2002 Shaya
2002/0174025 A1 11/2002 Hind
2002/0178013 A1 11/2002 Hoffman
2002/0194604 A1 12/2002 Sanchez
2003/0028424 A1 2/2003 Kampff
2003/0065520 A1 4/2003 Jutzi
2003/0083951 A1 5/2003 Connelly
2003/0088370 A1 5/2003 Bagepalli
2003/0107650 A1 6/2003 Colmenarez
2003/0126023 A1 7/2003 Crampton
2003/0130897 A1 7/2003 Pickover
2003/0130908 A1 7/2003 Hing
2003/0149693 A1 8/2003 Dobler
2003/0177072 A1 9/2003 Bared
2003/0212619 A1 11/2003 Jain
2004/0030531 A1 2/2004 Miller
2004/0064379 A1 4/2004 Anderson
2004/0100380 A1 5/2004 Lindsay
2004/0103043 A1 5/2004 Reade
2004/0117383 A1 6/2004 Lee
2004/0153442 A1 8/2004 Mantz
2004/0158497 A1 8/2004 Brand
2004/0165708 A1 8/2004 White
2004/0176987 A1 9/2004 Dial
2004/0198386 A1 10/2004 Dupray
2004/0225651 A1 11/2004 Musgrove
2005/0034161 A1 2/2005 Brown
2005/0049920 A1 3/2005 Day

(56) References Cited

U.S. PATENT DOCUMENTS

2005/0159996 A1 7/2005 Lazarus
2005/0187021 A1 8/2005 Daskalakis
2005/0189414 A1 9/2005 Fano
2005/0273377 A1 12/2005 Ouimet
2005/0283394 A1 12/2005 McGloin
2006/0010029 A1 1/2006 Gross
2006/0036485 A1 2/2006 Duri
2006/0055543 A1 3/2006 Ganesh
2006/0136293 A1 6/2006 Kasravi
2006/0183980 A1 8/2006 Yang
2006/0230053 A1 10/2006 Eldering
2006/0237532 A1 10/2006 Scott-Leikach
2006/0256008 A1 11/2006 Rosenberg
2006/0259360 A1 11/2006 Flinn
2006/0288374 A1 12/2006 Ferris
2007/0016488 A1 1/2007 Ulenas
2007/0050201 A1 3/2007 Gardner
2007/0073553 A1 3/2007 Flinn
2007/0179846 A1 8/2007 Jain
2007/0219866 A1 9/2007 Wolf
2007/0244741 A1 10/2007 Blume
2007/0265870 A1 11/2007 Song
2007/0290038 A1 12/2007 Woodcock
2007/0294133 A1 12/2007 Lasker
2007/0299724 A1 12/2007 Hales
2008/0004995 A1 1/2008 Klingenberg
2008/0043013 A1 2/2008 Gruttadauria
2008/0052171 A1 2/2008 Eldering
2008/0059297 A1 3/2008 Vallier
2008/0065468 A1 3/2008 Berg
2008/0071622 A1 3/2008 Walker
2008/0089288 A1 4/2008 Anschutz
2008/0114642 A1 5/2008 Goldberg
2008/0208673 A1 8/2008 Mebruer
2008/0248815 A1 10/2008 Busch
2008/0288327 A1 11/2008 Watarai
2009/0012704 A1 1/2009 Franco
2009/0018996 A1 1/2009 Hunt
2009/0063290 A1 3/2009 Mehew
2009/0083121 A1 3/2009 Angell
2009/0094121 A1 4/2009 Newhouse
2009/0128325 A1 5/2009 Ivanov
2009/0132347 A1 5/2009 Anderson
2009/0164772 A1 6/2009 Karkaria
2009/0166375 A1 7/2009 Butler
2009/0171968 A1 7/2009 Kane
2009/0197616 A1 8/2009 Lewis
2009/0234712 A1 9/2009 Kolawa
2009/0271293 A1 10/2009 Parkhurst
2009/0303052 A1 12/2009 Aklepi
2010/0030578 A1 2/2010 Siddique
2010/0042940 A1 2/2010 Monday
2010/0064040 A1 3/2010 Wise
2010/0084463 A1 4/2010 Huang
2010/0133850 A1 6/2010 Winkler
2010/0185552 A1 7/2010 Deluca
2010/0198668 A1 8/2010 Resnick
2010/0216509 A1 8/2010 Riemer
2010/0293032 A1 11/2010 Engelsma
2010/0293569 A1 11/2010 Kusumoto
2011/0004588 A1 1/2011 Leitersdorf
2011/0022606 A1 1/2011 Mason
2011/0035282 A1 2/2011 Spatscheck
2011/0131089 A1 6/2011 Walker
2011/0213661 A1 9/2011 Milana
2011/0218859 A1 9/2011 Wang
2011/0225046 A1 9/2011 Eldering
2011/0246260 A1 10/2011 Gilbert
2011/0246306 A1 10/2011 Blackhurst
2011/0251897 A1 10/2011 Litvack
2011/0267374 A1 11/2011 Sakata
2011/0282476 A1 11/2011 Hegemier
2011/0302011 A1 12/2011 Yoder
2011/0316697 A1 12/2011 Krahnstoever
2012/0019378 A1 1/2012 Watson
2012/0036522 A1 2/2012 Wang
2012/0054018 A1 3/2012 Pradeep
2012/0150626 A1 6/2012 Zhang
2012/0166268 A1 6/2012 Griffiths
2012/0259732 A1 10/2012 Sasankan
2012/0271740 A1 10/2012 Connors
2012/0310715 A1 12/2012 Singhal
2013/0030915 A1 1/2013 Statler
2013/0031018 A1 1/2013 Jellum
2013/0066740 A1 3/2013 Ouimet
2013/0073389 A1 3/2013 Heath
2013/0080364 A1 3/2013 Wilson
2013/0091146 A1 4/2013 Stanger
2013/0106604 A1 5/2013 Lee
2013/0138530 A1 5/2013 Westphal
2013/0232221 A1 5/2013 Brechner
2013/0140357 A1 6/2013 Ure
2013/0175335 A1 7/2013 Roberts
2013/0176115 A1 7/2013 Puleston
2013/0214938 A1 8/2013 Kim
2013/0226539 A1 8/2013 Shaw
2013/0268317 A1 10/2013 Mattila
2013/0268335 A1 10/2013 Cooper
2013/0268886 A1 10/2013 Sureshkumar
2013/0275275 A1 10/2013 Lemmons
2013/0311324 A1 11/2013 Stoll
2013/0326008 A1 12/2013 Morgan
2013/0339122 A1 12/2013 Truitt
2014/0002643 A1 1/2014 Aziz
2014/0040038 A1 2/2014 Hermanowski
2014/0052562 A1 2/2014 Oliveira
2014/0058775 A1 2/2014 Siig
2014/0058794 A1 2/2014 Malov
2014/0074649 A1 3/2014 Patel
2014/0074743 A1 3/2014 Rademaker
2014/0089133 A1 3/2014 Argue
2014/0108125 A1 4/2014 Maraz
2014/0122228 A1 5/2014 Wical
2014/0129393 A1 5/2014 Soon-Shiong
2014/0156392 A1 6/2014 Ouimet
2014/0164046 A1 6/2014 Haralambos
2014/0164476 A1 6/2014 Thomson
2014/0180815 A1 6/2014 Chatwin
2014/0180953 A1 6/2014 Westcott
2014/0195902 A1 7/2014 Yang
2014/0207659 A1 7/2014 Erez
2014/0214543 A1 7/2014 Gandhi
2014/0214590 A1 7/2014 Argue
2014/0214600 A1 7/2014 Argue
2014/0249966 A1 9/2014 Zaragoza
2014/0266791 A1 9/2014 Lloyd
2014/0278815 A1 9/2014 Grant
2014/0279200 A1 9/2014 Hosein
2014/0279202 A1 9/2014 Egozi
2014/0279208 A1 9/2014 Nickitas
2014/0279294 A1 9/2014 Field-Darragh
2014/0297001 A1 10/2014 Silverman
2014/0297470 A1 10/2014 Ramadge
2014/0304123 A1 10/2014 Schwartz
2014/0310040 A1 10/2014 Carmichael
2014/0310056 A1 10/2014 Alapati
2014/0316916 A1 10/2014 Hay
2014/0330738 A1 11/2014 Falcone
2014/0344102 A1 11/2014 Cooper
2015/0006314 A1 1/2015 Goulart
2015/0032847 A1 1/2015 Van Coppenolle
2015/0058154 A1 2/2015 Appleyard
2015/0058175 A1 2/2015 Axt
2015/0081469 A1 3/2015 Acharyya
2015/0106236 A1 4/2015 Morris
2015/0120550 A1 4/2015 Jung
2015/0120600 A1 4/2015 Luwang
2015/0139416 A1 5/2015 Skiba
2015/0149443 A1 5/2015 Aravamudan
2015/0161706 A1 6/2015 Karmakar
2015/0186773 A1 7/2015 Weill
2015/0186981 A1 7/2015 Holman
2015/0190086 A1 7/2015 Chan
2015/0193115 A1 7/2015 Chirakan

(56) References Cited

U.S. PATENT DOCUMENTS

| | | | | |
|---|---|---|---|---|
| 2015/0206246 | A1 | 7/2015 | Lange | |
| 2015/0221016 | A1 | 8/2015 | Schulz | |
| 2015/0227871 | A1 | 8/2015 | Zeile | |
| 2015/0227883 | A1 | 8/2015 | Murphy | |
| 2015/0242750 | A1 | 8/2015 | Anderson | |
| 2015/0254712 | A1 | 9/2015 | Chen | |
| 2015/0254785 | A1 | 9/2015 | Yang | |
| 2015/0256899 | A1 | 9/2015 | Chand | |
| 2015/0269642 | A1 | 9/2015 | Cai | |
| 2015/0310536 | A1 | 10/2015 | Brady | |
| 2015/0324490 | A1 | 11/2015 | Page | |
| 2015/0324881 | A1 | 11/2015 | Ouimet | |
| 2015/0356601 | A1 | 12/2015 | Lu | |
| 2015/0370985 | A1 | 12/2015 | Carvalko | |
| 2015/0379597 | A1 | 12/2015 | Gupta | |
| 2016/0005070 | A1 | 1/2016 | Burr | |
| 2016/0027068 | A1 | 1/2016 | Brantley | |
| 2016/0027094 | A1 | 1/2016 | Chamyvelumani | |
| 2016/0034907 | A1 | 2/2016 | Worrall | |
| 2016/0063440 | A1 | 3/2016 | Webb | |
| 2016/0071116 | A1 | 3/2016 | Atkins | |
| 2016/0086255 | A1 | 3/2016 | Sainfort | |
| 2016/0092988 | A1 | 3/2016 | Letourneau | |
| 2016/0094703 | A1 | 3/2016 | Wernevi | |
| 2016/0098547 | A1 | 4/2016 | Char | |
| 2016/0110759 | A1 | 4/2016 | Polehn | |
| 2016/0140589 | A1 | 5/2016 | Deshpande | |
| 2016/0171424 | A1 | 6/2016 | Kannan | |
| 2016/0171539 | A1 | 6/2016 | Ganduri | |
| 2016/0171597 | A1 | 6/2016 | Todeschini | |
| 2016/0171866 | A1 | 6/2016 | Dupasquier | |
| 2016/0239857 | A1 | 8/2016 | Milton | |
| 2016/0253710 | A1 | 9/2016 | Publicover | |
| 2016/0283979 | A1 | 9/2016 | Chatterton | |
| 2016/0292634 | A1 | 10/2016 | Mehring | |
| 2016/0292769 | A1 | 10/2016 | Colson | |
| 2016/0300547 | A1 | 10/2016 | El-Rukby | |
| 2016/0345869 | A1 | 12/2016 | Rishi | |
| 2016/0350715 | A1 | 12/2016 | Minvielle | |
| 2016/0371650 | A1 | 12/2016 | Schmidt | |
| 2017/0109806 | A1 | 4/2017 | Adoni | |
| 2017/0180147 | A1* | 6/2017 | Brandman | H04W 4/70 |
| 2017/0300856 | A1 | 10/2017 | Wilkinson | |
| 2017/0300936 | A1 | 10/2017 | Wilkinson | |
| 2017/0300944 | A1 | 10/2017 | Wilkinson | |
| 2017/0300946 | A1 | 10/2017 | Wilkinson | |
| 2017/0300956 | A1 | 10/2017 | Cantrell | |
| 2017/0300992 | A1 | 10/2017 | Wilkinson | |
| 2017/0300999 | A1 | 10/2017 | Wilkinson | |
| 2017/0301000 | A1 | 10/2017 | Morgan | |
| 2017/0301001 | A1 | 10/2017 | Wilkinson | |
| 2017/0301002 | A1 | 10/2017 | Wilkinson | |
| 2017/0301008 | A1 | 10/2017 | Houdek-Heis | |
| 2017/0308909 | A1* | 10/2017 | Faith | G06Q 30/0201 |
| 2017/0345033 | A1 | 11/2017 | Wilkinson | |
| 2017/0364860 | A1 | 12/2017 | Wilkinson | |
| 2017/0364925 | A1 | 12/2017 | Wilkinson | |
| 2017/0364962 | A1 | 12/2017 | Wilkinson | |
| 2018/0005177 | A1 | 1/2018 | Wilkinson | |
| 2018/0025365 | A1 | 1/2018 | Wilkinson | |
| 2018/0040044 | A1 | 2/2018 | Mattingly | |
| 2018/0047065 | A1* | 2/2018 | Wildberger | H04L 67/22 |
| 2018/0053240 | A1 | 2/2018 | Jones | |
| 2018/0060943 | A1 | 3/2018 | Mattingly | |
| 2018/0082252 | A1 | 3/2018 | Wilkinson | |
| 2018/0083908 | A1* | 3/2018 | Dotan-Cohen | H04L 51/04 |
| 2018/0107971 | A1 | 4/2018 | Vukin | |
| 2018/0108062 | A1 | 4/2018 | McHale | |
| 2018/0113431 | A1 | 4/2018 | Wilkinson | |
| 2018/0137461 | A1 | 5/2018 | Wilkinson | |
| 2018/0144397 | A1 | 5/2018 | Wilkinson | |
| 2018/0174101 | A1 | 6/2018 | Mattingly | |
| 2018/0174188 | A1 | 6/2018 | Wilkinson | |
| 2018/0174198 | A1 | 6/2018 | Wilkinson | |
| 2018/0174223 | A1 | 6/2018 | Cantrell | |
| 2018/0174224 | A1 | 6/2018 | Wilkinson | |
| 2018/0254096 | A1* | 9/2018 | Karunanithi | A61B 5/746 |
| 2018/0268357 | A1 | 9/2018 | Cantrell | |
| 2018/0285816 | A1 | 10/2018 | Mattingly | |
| 2018/0300677 | A1 | 10/2018 | Wilkinson | |
| 2018/0300788 | A1 | 10/2018 | Mattingly | |
| 2019/0005021 | A1* | 1/2019 | Miller | G06F 17/279 |

FOREIGN PATENT DOCUMENTS

| | | |
|---|---|---|
| CN | 203299604 | 11/2013 |
| CN | 203405712 | 1/2014 |
| CN | 203745868 | 7/2014 |
| EP | 3018591 | 5/2016 |
| JP | 2002123716 | 4/2002 |
| KR | 101220581 | 1/2013 |
| KR | 20130082894 | 7/2013 |
| KR | 101595538 | 2/2016 |
| WO | 2000033228 | 6/2000 |
| WO | 2000070481 | 11/2000 |
| WO | 2000073958 | 12/2000 |
| WO | 2001011511 | 2/2001 |
| WO | 2001073651 | 10/2001 |
| WO | 2001075680 | 10/2001 |
| WO | 2002003267 | 1/2002 |
| WO | 2006006940 | 1/2006 |
| WO | 2007041275 | 4/2007 |
| WO | 2007072579 | 6/2007 |
| WO | 2014195902 | 12/2014 |
| WO | 2015123751 | 8/2015 |
| WO | 2015171072 | 11/2015 |
| WO | 2016018994 | 2/2016 |
| WO | 2016085827 | 6/2016 |

OTHER PUBLICATIONS

PCT; App. No. PCT/US2017/040855: International Search Report and Written Opinion dated Sep. 13, 2017.

USPTO; U.S. Appl. No. 15/642,738; Office Action dated Mar. 23, 2018 (pp. 1-10).

Yin, J. et al; "Sensor-Based Abnormal Human-Activity Detection"; IEEE Transactions on Knowledge and Data Engineering; vol. 20, Issue: 8. Aug. 2008; published on Jun. 27, 2008 ; pp. 1-25.

U.S. Appl. No. 15/487,538, filed Apr. 14, 2017, Bruce W. Wilkinson.

U.S. Appl. No. 15/487,728, filed Apr. 14, 2017, Bruce W. Wilkinson.

U.S. Appl. No. 15/487,760, filed Apr. 14, 2017, Starla C. Morgan.

U.S. Appl. No. 15/487,775, filed Apr. 14, 2017, Robin Houdek-Heis.

U.S. Appl. No. 15/487,792, filed Apr. 14, 2017, Robert L. Cantrell.

U.S. Appl. No. 15/487,826, filed Apr. 14, 2017, Bruce W. Wilkinson.

U.S. Appl. No. 15/487,882, filed Apr. 14, 2017, Bruce W. Wilkinson.

U.S. Appl. No. 15/487,894, filed Apr. 14, 2017, Bruce W. Wilkinson.

U.S. Appl. No. 15/488,004, filed Apr. 14, 2017, Bruce W. Wilkinson.

U.S. Appl. No. 15/488,015, filed Apr. 14, 2017, Bruce W. Wilkinson.

U.S. Appl. No. 15/488,107, filed Apr. 14, 2017, Bruce W. Wilkinson.

U.S. Appl. No. 15/606,602, filed May 26, 2017, Bruce W. Wilkinson.

U.S. Appl. No. 15/624,030, filed Jun. 15, 2017, Bruce W. Wilkinson.

U.S. Appl. No. 15/625,599, filed Jun. 16, 2017, Bruce W. Wilkinson.

U.S. Appl. No. 15/628,282, filed Jun. 20, 2017, Bruce W. Wilkinson.

U.S. Appl. No. 15/634,862, filed Jun. 27, 2017, Bruce W. Wilkinson.

U.S. Appl. No. 15/655,339, filed Jul. 20, 2017, Bruce W. Wilkinson.

U.S. Appl. No. 15/669,546, filed Aug. 4, 2017, Todd D. Mattingly.

U.S. Appl. No. 15/678,608, filed Aug. 16, 2017, Nicholaus A. Jones.

U.S. Appl. No. 15/685,981, filed Aug. 24, 2017, Todd D. Mattingly.

U.S. Appl. No. 15/704,878, filed Sep. 14, 2017, Bruce W. Wilkinson.

U.S. Appl. No. 15/782,509, filed Oct. 12, 2017, Greg N. Vukin.

U.S. Appl. No. 15/782,555, filed Oct. 12, 2017, Todd D. Mattingly.

U.S. Appl. No. 15/782,559, filed Oct. 12, 2017, Bruce W. Wilkinson.

U.S. Appl. No. 15/783,551, filed Oct. 13, 2017, Bruce W. Wilkinson.

U.S. Appl. No. 15/783,645, filed Oct. 13, 2017, Bruce W. Wilkinson.

U.S. Appl. No. 15/783,668, filed Oct. 13, 2017, Brian G. McHale.

U.S. Appl. No. 15/783,787, filed Oct. 13, 2017, Robert L. Cantrell.

U.S. Appl. No. 15/783,825, filed Oct. 13, 2017, Bruce W. Wilkinson.

U.S. Appl. No. 15/783,929, filed Oct. 13, 2017, Bruce W. Wilkinson.

(56) References Cited

OTHER PUBLICATIONS

U.S. Appl. No. 15/783,960, filed Oct. 13, 2017, Bruce W. Wilkinson.
U.S. Appl. No. 15/921,540, filed Mar. 14, 2018, Robert L. Cantrell.
U.S. Appl. No. 15/939,788, filed Mar. 29, 2018, Todd D. Mattingly.
U.S. Appl. No. 15/952,494, filed Apr. 13, 2018, Bruce W. Wilkinson.
U.S. Appl. No. 15/953,113, filed Apr. 13, 2018, Todd D. Mattingly.
"Amazon Alexa;" Wikipedia; https://web.archive.org/web/20160926125220/https://en.wikipedia.org/wiki/Amazon_Alexa; Sep. 26, 2016; pp. 1-4.
"Amazon Dash Buttons;" Amazon; https://web.archive.org/web/20160623172354/https://www.amazon.com/Dash-Buttons/b?ie=UTF8&node=10667898011; Jun. 23, 2016; pp. 1-8.
"Amazon Dash;" Wikipedia; https://web.archive.org/web/20160310021300/https://en.wikipedia.org/wiki/Amazon_Dash; Mar. 10, 2016; pp. 1-2.
"Amazon Echo;" Amazon; https://web.archive.org/web/20160602024155/https://www.amazon.com/Amazon-Echo-Bluetooth-Speaker-with-WiFi-Alexa/dp/B00X4WHP5E; Jun. 2, 2016; pp. 1-10.
"Predicting Customer Needs with Forward Demand;" Blue Yonder; https://www.blueyonder.com/en/products/forward-demand.html; retrieved on Mar. 16, 2016; pp. 1-11.
Anagnostopoulos, Aris, et al.; "The Importance of Being Expert: Efficient Max-Finding in Crowdsourcing"; SIGMOD'15; ACM; May 31-Jun. 4, 2015; pp. 983-998.
Aung, Myo Min, et al.; "Quality Monitoring and Dynamic Pricing in Cold Chain Management"; World Academy of Science, Engineering and Technology International Journal of Mechanical, Aerospace, Industrial, Mechatronic and Manufacturing Engineering; vol. 6, No. 2; published 2012; pp. 454-458.
Bergen, Jennifer; "Korea's Tesco reinvents grocery shopping with QR-code 'stores'"; https://www.geek.com/mobile/koreas-tesco-reinvents-grocery-shopping-with-qr-code-stores-1396025/; Jun. 28, 2011; pp. 1-8.
Bid and Barter; "Bid and Barter"; http://www.bidandbarter.com/about.html; Retrieved on Nov. 24, 2016; pp. 1-2.
Borowski, Craig; "6 Tips to Shift from Reactive to Proactive Customer Service"; https://www.softwareadvice.com/resources/6-tips-shift-reactive-proactive-customer-service/; Retrieved on Nov. 22, 2016; pp. 1-9.
Cognizant; "Omnichannel Retailing | The Ditial Sotre of the Future | Cognizant"; http://www.youtube.com/watch?v=CRaiadNn_nw; published on Sep. 1, 2015; pp. 1-5.
E-Thele SQD Networks; "360 degree retail surveillance & loss prevention video", https://www.youtube.com/watch?v=NgELfYPnMvQ, published on Jul. 29, 2013, pp. 1-5.
Erlibird; "Recommendation System that Uses Big Data to Help People Find Gifts for their Facebook Friends"; https://erlibird.com/go/giftri-com; retrieved on May 30, 2016; pp. 1-4.
Ernst & Young LLP and the Retailers Association of India; "Movement of Goods in India"; rasci.in/downloads/2013/Movement_Goods_India.pdf; published on Dec. 5, 2013; pp. 1-28.
Giering, Michael; "Retail Sales Prediction and Item Recommendations Using Customer Demographics at Store Level"; ACM SIGKDD Explorations Newsletter; vol. 10, Issue 2, Dec. 2008; pp. 84-89.
Gustafson, Krystina; "The anti-Amazons: Two brands shaking up retail"; http://www.cnbc.com/2016/03/22/the-anti-amazons-two-brands-shaking-up-retail.html; Mar. 28, 2016; pp. 1-8.
He, Jianming et al.; "A Social Network-Based Recommender System (SNRS)"; Annals of Information Systems book series; vol. 12; May 20, 2010; pp. 47-74.
Hewlett-Packard; "HP C350B 8 gb USB Pen Drive With 1 Year Norton"; Amazon.com, http://www.amazon.in/HP-C350B-DRIVE-NORTON-ANtivirus/dp/B00GZHE9KO; retrieved on Apr. 18, 2016, pp. 1.
Home Chef; "Home Chef Meal Delivery Service, Fresh Ingredients to Cook at Home"; https://web.archive.org/web/20160705144946/https://www.homechef.com/; available at least as early as Jul. 5, 2016; pp. 1-4.
IGoDigital; "iGoDigital: Creating a Personalized Multi-Channel Shopping Experience with Product Recommendations"; http://www.youtube.com/watch?v=Zynd4RLnV5I; published on Aug. 15, 2012; pp. 1-4.
IP.com; "Intelligent Online Shopping Cart Which Can Automatically Pre-Load a Shopping List;" Prior Art Database; http://priorart.ip.com/IPCOM/00236206; Apr. 11, 2016; pp. 1-11.
Jank, Wolfgang, et al.; "Understanding Geographical Markets of Online Firms Using Spatial Models of Customer Choice"; Marketing Science; vol. 24, No. 4; Fall 2005; pp. 623-634.
Karim, Shah; "Seven Retail Megatrends for 2020;" Chain Store Age; http://www.chainstoreage.com/article/seven-retail-megatrends-2020; Feb. 22, 2015; pp. 1-3.
Kelso, Alicia; "Pizza Hut Serves Up Custom Pies on Interactive Tabletops"; http://www.kioskmarketplace.com/articles/pizza-hut-serves-up-custom-pies-on-interactive-tabletops/; Jun. 28, 2016; pp. 1-2.
Keng, Brian; "Beyond Collaborative Filtering (Part 1)"; http://rubikloud.com/labs/data-science/beyond-collaborative-filtering/; May 18, 2016; pp. 1-5.
Khan, Sal; "The dot product"; https://www.khanacademy.org/science/physics/magnetic-forces-and-magnetic-fields/electric-motors/v/the-dot-product; published on Aug. 8, 2008, pp. 1-15.
Kiosk; "Vending Kiosk Software"; http://kiosk.com/market-solutions/vending-rental; Retrieved on Jun. 28, 2016; pp. 1-8.
Kohan, Shelley E.; "5 Retail Trends for 2015;" RetailNext; https://retailnext.net/en/blog/retail-trends-2015/; Feb. 24, 2015; pp. 1-4.
Kohn, David, et al.; "A New Social Proof Application for Online Retailers that Drives Conversions"; http://www.barilliance.com/social-proof-application-for-ecommerce-sites/; Retrieved on Feb. 17, 2016; pp. 1-6.
Listonic SP. Z O.O.; "Smart Shopping List—Listonic"; https://play.google.com/store/apps/details?id=com.l; Retrieved on Nov. 24, 2016; pp. 1-3.
Lu, Haiyun; "Recommendations Based on Purchase Patterns;" International Journal of Machine Learning and Computing; vol. 4, No. 6; Dec. 2014; pp. 501-504.
Maras, Elliot; "RFID: A Tool for Tracking Products, Assets and More"; http://www.foodlogistics.com/article/12141721/rfid-a-tool-for-tracking-products-assets-and-more; Dec. 17, 2015; pp. 1-9.
Mathisfun; "Dot Product"; https://web.archive.org/web/20140320190422/https://www.mathsisfun.com/algebra/vectors-dot-product.html; available at least Femeralas early as Mar. 20, 2014; pp. 1-5.
Mcdonald, Heath; "Who are "innovators" and do they matter?"; Marketing Intelligence & Planning; vol. 25, No. 5; 2007; pp. 1-18.
Menczer, Filippo, et al.; "Adaptive Assistants for Customized E-Shopping;" IEEE Intelligent Systems; vol. 17, Issue 6; Nov./Dec. 2002; https://www.computer.org/csdl/mags/ex/2002/06/x6012-abs.html; pp. 12-19.
Miles, Stephanie; "8 Tools for the In-Store Delivery of Mobile Coupons"; http://streetfightmag.com/2013/07/30/8-tools-for-the-in-store-delivery-of-mobile-coupons-2/; Jul. 30, 2013; pp. 1-6.
Neo4j; "Walmart uses Neo4j to optimize customer experience with personal recommendations"; http://info.neo4j.com/rs/neotechnology/images/neo4j-casestudy-walmart.pdf; Retrieved on Mar. 29, 2016; pp. 1-2.
Organizy Ltd.; "Organizy Grocery Shopping List"; https://play.google.com/store/apps/details?id=com.organizy.shopping.list; Retrieved on Nov. 24, 2016; pp. 1-3.
Prassas, George, et al.; "Dynamic Recommendations in Internet Retailing"; Global Co-Operation in the New Millennium: The 9th European Conference on Information Systems; Athens University of Economics and Business; Jun. 27-29, 2001; pp. 368-379.
Shoukas, Denise; "The Future of Food Shopping Is Here"; https://www.specialtyfood.com/news/article/future-food-shopping-here/; Jun. 24, 2013; pp. 1-8.
Study.com; "Classes of Adopters: Innovators, Early, Late and Laggards"; http://study.com/academy/lesson/classes-of-adopters-innovators-early-late-and-laggards.html; retrieved on Oct. 13, 2016; pp. 1-4.
Tan, Soo-Jiuan; "Predicting Innovation Adoption: a Choice-Based Approach"; In AP—Asia Pacific Advances in Consumer Research; vol. 1; National University of Singapore; 1994; pp. 72-78.

(56) References Cited

OTHER PUBLICATIONS

Uhler, David, et al.; "Mobile Computing, Applications, and Services"; Lecture Notes of the Institute for Computer Science, Social Informatics and Telecommunications Engineering; Feb. 5, 2013; pp. 380.
Vasal, Ityam; "Gift Recommender System for Amazon;" 583 Term Paper; retrieved on May 30, 2016; pp. 1-9.
Vendhq; "Retail Trends and Predictions 2016"; https://www.vendhq.com/us/university/retail-trends-and-predictions-2016; available at least as early as 2016; pp. 1-19.
Wikipedia; "Dot Product"; https://web.archive.org/web/20140815031517/https://en.wikipedia.org/wiki/Dot_product; available at least as early as Aug. 15, 2014; pp. 1-8.
Wylie, Jonathan; "How to Read QR Codes With a Smartphone"; https://www.pcworld.com/article/242873/how_to_read_qr_codes_with_a_smartphone.html; Nov. 1, 2011; pp. 1-3.
Zhu, Wei, et al.; "Personalized In-Store E-Commerce with the PromoPad: An Augmented Reality Shopping Assistant"; https://www.researchgate.net/publication/228786852_Personalized_In-store_E-Commerce_with_the_PromoPad_an_Augmented_Reality_Shopping_Assistant; Jan. 2004; pp. 1-19.

* cited by examiner

APPARATUS AND METHOD FOR UPDATING PARTIALITY VECTORS BASED ON MONITORING OF PERSON AND HIS OR HER HOME

RELATED APPLICATION(S)

This application is a continuation-in-part of U.S. application Ser. No. 15/642,738 filed Jul. 6, 2017 which claims the benefit of U.S. Provisional Application No. 62/359,462 filed Jul. 7, 2016. This application claims the benefit of U.S. Provisional Application No. 62/485,045 filed Apr. 13, 2017. All of the above-noted applications are all incorporated by reference in their entirety herein.

TECHNICAL FIELD

This invention relates generally to monitoring systems and, more particularly, to systems for monitoring deviations in a person's activity.

BACKGROUND

While people typically don't perform the same tasks each day, eat the same meals each day, travel to the same locations each day, etc., most people have fairly routine schedules. For example, although an individual may not eat the exact same meal for dinner every night, he or she may have a meal pattern that is relatively consistent from week-to-week or month-to-month. As another example, although an individual may not travel to the same locations every day, he or she may typically go to the grocery store on Mondays, to the gym on Tuesdays and Thursdays, and out to one of a select number of restaurants on Fridays. Oftentimes, a deviation from these routines or patterns may signal that something is wrong or that something has changed in the person's life. Consequently, a way to better understand a person's routines may be useful in predicting problems, or changes, with that person and/or his or her routines.

BRIEF DESCRIPTION OF THE DRAWINGS

Disclosed herein are embodiments of systems, apparatuses and methods pertaining detecting a deviation in a person's activity. This description includes drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to various embodiments, systems, apparatuses, and methods are provided herein useful to detecting a deviation in a person's activity. In some embodiments, an apparatus comprises one or more sensors, the one or more sensors configured to monitor parameters associated with a person and the person's home, and a control circuit, the control circuit communicatively coupled to the one or more sensors and configured to generate one or more partiality vectors for the person, wherein the one or more partiality vectors have at least one of a magnitude and an angle that corresponds to a magnitude of the person's belief in an amount of good that comes from an order associated with that partiality, receive, from the one or more sensors, values associated with the parameters, create, based on the values associated with the parameters, a spectral profile for the person, determine, based on the spectral profile and a routine experiential base state for the person, that a combination of the values indicates a deviation, and update, based on the deviation, at least one of the one or more partiality vectors for the person.

Figure 1:
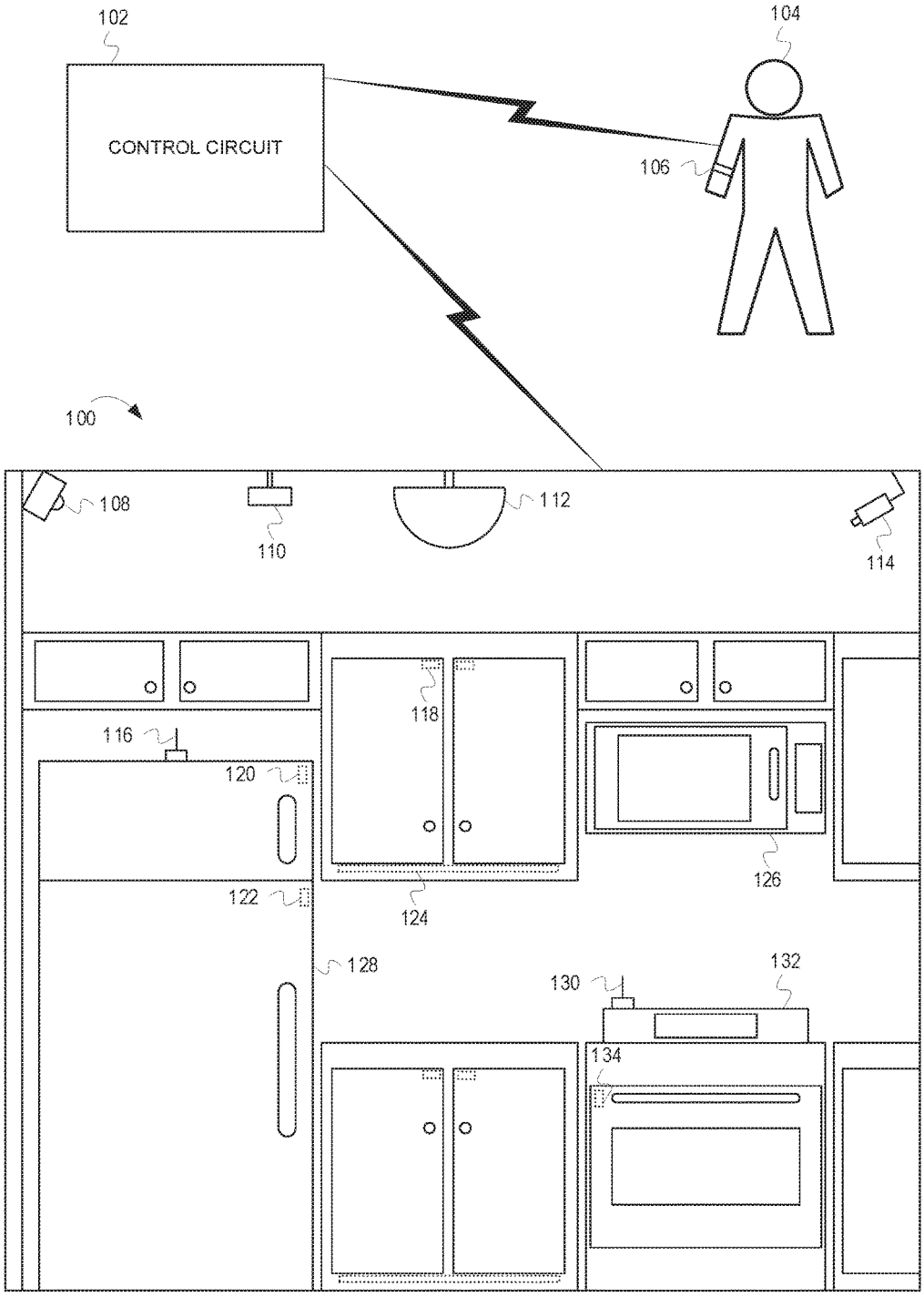
FIG. 1 is a diagram of a person 104 and a portion of his or her home 100 including multiple sensors, according to some embodiments.

As previously discussed, most people have fairly routine schedules from day-to-day, week-to-week, month-to-month, etc. Further, understanding a person's routines may be useful in detecting problems, or changes, with that person and/or his or her routines. For example, if a person who normally goes to the gym on Tuesdays and Thursdays stops going to the gym on Tuesdays and Thursdays, it may indicate that he or she isn't feeling well or has decided that going to the gym is not worth the effort. In addition to determining a deviation (e.g., no longer going to the gym), an alert can be sent indicating that he or she is no longer going to the gym. For example, the person could set an alert to be sent to his or her friend so that his or her friend will know he or she is no longer going to the gym and attempt to motivate him or her to resume going to the gym. Described herein are systems, methods, and apparatuses that can monitor a person and his or her environment, determine that the person has deviated from his or her normal routine, and cause an alert to be transmitted that indicates that there has been a deviation. FIG. 1 provides some background information for such a system.

FIG. 1 is a diagram of a person 104 and a portion of his or her home 100 including multiple sensors, according to some embodiments. The person's 104 home 100 includes a variety of different sensors. The sensors can include motion sensors, image sensors, noise sensors, light sensors, weight sensors, usage sensors, door sensors, utility usage sensors, or any other suitable type of sensor. Additionally, the person 104 can wear, or otherwise host, sensors on or in his or her body.

The portion of the person's 104 home 100 depicted in FIG. 1 is the kitchen. The kitchen includes a motion sensor 108, a noise sensor 110 (e.g., a microphone), a light sensor housed within a light fixture 112, an image sensor 114 (e.g., a video camera or a still camera), cabinet door sensors 118, and cabinet weight sensors 124. The motion sensor 108 can monitor motion and activity within the kitchen. The noise sensor 110 can monitor noise within the kitchen. The cabinet door sensors 118 can monitor opening and closing and/or the state (e.g., open or closed) of the cabinet door(s). The cabinet weight sensors 124 can monitor items within the cabinet. For example, the weight sensors 124 may span a portion of the cabinet's footprint that is large enough to accommodate several items. In such embodiments, the cabinet weight sensor 124 may generally monitor the weight of items in the cabinet. In other embodiments, the cabinet weight sensor 124 may include multiple smaller weight sensors. In such embodiments the person 104 can arrange items in the cabinet so that the cabinet weight sensors 124 can monitor how much of an item remains, or the presence of an item in the cabinet. The light sensor can monitor light in the kitchen and/or energy usage of the light fixture 112.

The appliances within the kitchen can also include a variety of sensors. For example, a refrigerator 128 includes a freezer door sensor 120 and a refrigerator door sensor 122 and an oven 132 includes an over door sensor 134. Although not depicted, the oven 132, refrigerator 128, and microwave 126 can also include usage sensors (e.g., energy usage, operational time, operational parameters, etc.) and/or weight sensors similar to the cabinet weight sensors 124 included in the cabinet. While FIG. 1 depicts only the person's 104 kitchen, the rest of the home 100 can also include sensors similar to those depicted in the kitchen.

In FIG. 1, the person 104 is wearing a fitness band 106. The fitness band 106 can include a plurality of sensors that can monitor the person's 104 vital signs, bodily functions, location, activity, etc. For example, the fitness band 106 can include a pedometer, an accelerometer, a motion sensor, a heart rate sensor, an image sensor, a noise sensor, an activity sensor, a blood pressure sensor, a location sensor (e.g., a GPS transceiver), etc. Although FIG. 1 only depicts the person 104 as wearing the fitness band 106, in some embodiments, the person can wear (or otherwise possess) additional sensor and/or devices having sensors.

The sensors, or an appliance associated with a sensor, can also include a transmitter (or transceiver). For example, the refrigerator 128 includes a refrigerator transmitter 116 and the oven 132 includes an oven transmitter 130. Likewise, the fitness band 106 can include a transmitter. The sensors, as well as the transmitters, are operable to transmit data to a control circuit 102. The data can include values associated with parameters monitored by the sensors. The control circuit 102 monitors and processes the data. The control circuit 102 processes the data to determine deviations from the person's normal routine. In some embodiments, the control circuit 102 may require a learning phase during set up. In such embodiments, the control circuit 102 processes the data to learn the person's 104 normal routine. Upon detecting a deviation from the person's 104 normal routine, the control circuit 102 can determine a type of alert that is appropriate based on the deviation as well as an appropriate recipient for the alert. The control circuit 102 can also transmit, or cause transmission of, the alert to the recipient.

Figure 2:
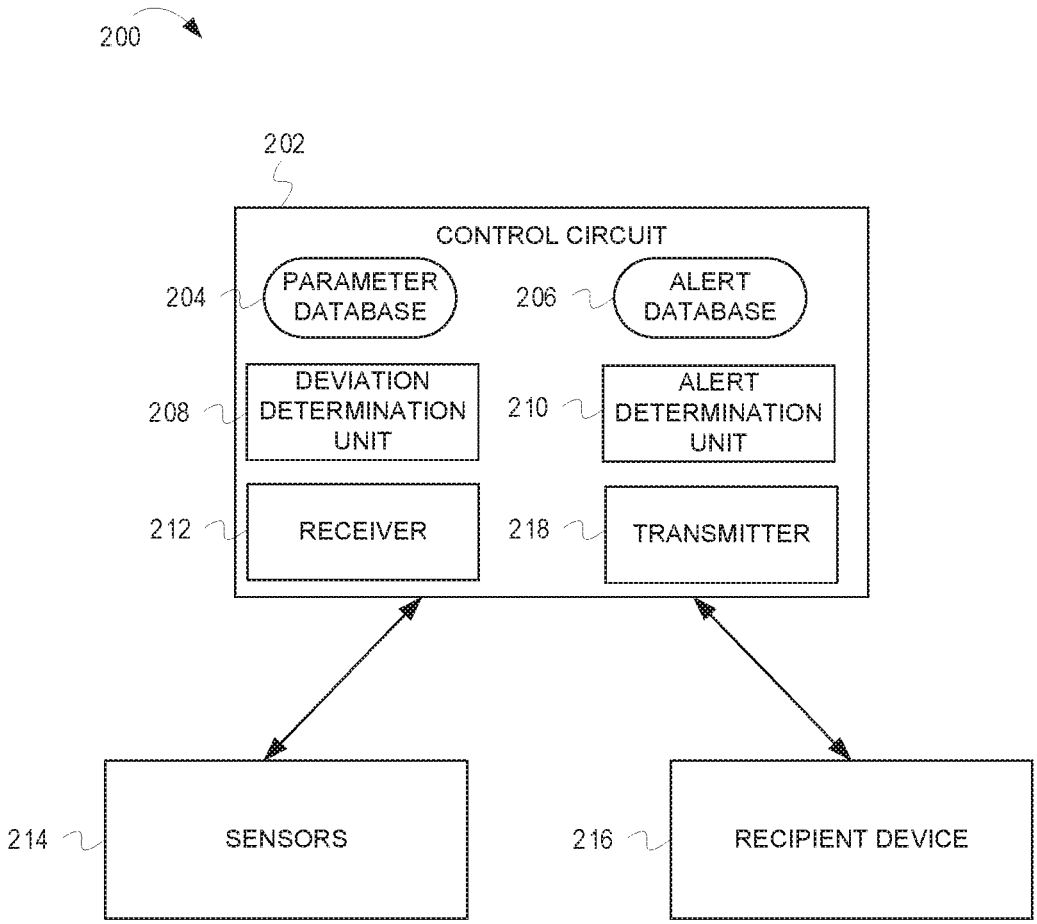
FIG. 2 is a block diagram of a system 200 for detecting a deviation in a person's activity, according to some embodiments.

While FIG. 1 and the related text provide background information about a system that can detect deviations from a person's normal routine and transmit alerts based on the deviations, FIG. 2 and the related text describe an example system that can detect deviations from a person's normal routine and transmit alerts based on the deviations.

FIG. 2 is a block diagram of a system 200 for detecting a deviation in a person's activity, according to some embodiments. The system 200 includes a control circuit 202, sensors 214, and a recipient device 216. The sensors 214 can be any type, and number, of sensors suitable for monitoring parameters associated with a person and indicative of, or associated with, his or her activities. The sensors 214 are in communication with the control circuit 202 and transmit data to the control circuit 202 for processing. The data can include values associated with the parameters.

The control circuit 202 can comprise a fixed-purpose hard-wired hardware platform (including but not limited to an application-specific integrated circuit (ASIC) (which is an integrated circuit that is customized by design for a particular use, rather than intended for general-purpose use), a field-programmable gate array (FPGA), and the like) or can comprise a partially or wholly-programmable hardware platform (including but not limited to microcontrollers, microprocessors, and the like). These architectural options for such structures are well known and understood in the art and require no further description here. The control circuit 202 is configured (for example, by using corresponding programming as will be well understood by those skilled in the art) to carry out one or more of the steps, actions, and/or functions described herein.

By one optional approach the control circuit 202 operably couples to a memory. The memory may be integral to the control circuit 202 or can be physically discrete (in whole or in part) from the control circuit 202 as desired. This memory can also be local with respect to the control circuit 202 (where, for example, both share a common circuit board, chassis, power supply, and/or housing) or can be partially or wholly remote with respect to the control circuit 202 (where, for example, the memory is physically located in another facility, metropolitan area, or even country as compared to the control circuit 202).

This memory can serve, for example, to non-transitorily store the computer instructions that, when executed by the control circuit 202, cause the control circuit 202 to behave as described herein. As used herein, this reference to "non-transitorily" will be understood to refer to a non-ephemeral state for the stored contents (and hence excludes when the stored contents merely constitute signals or waves) rather than volatility of the storage media itself and hence includes both non-volatile memory (such as read-only memory (ROM) as well as volatile memory (such as an erasable programmable read-only memory (EPROM).

The control circuit 202 includes a parameter database 204, an alert database 206, a deviation determination unit 208, an alert determination unit 210, a receiver 212, and a transmitter 218. Although depicted as individual units, in some embodiments the receiver 212 and the transmitter 218 can be a single unit, such as a transceiver. The parameter database 204 includes the parameters that are, or can be, monitored by the sensors 214. As one example, the parameter database 204 can include an array of the parameters and the types of sensors 214 with which the parameters are associated. In some embodiments, the parameter database 204, or another database (e.g., a dedicated user database), can include an array of users and the sensors associated with the user's account, as well and information about each user's routines.

The deviation determination unit 208 processes the data from the sensors 214 to determine if a deviation has occurred with regard to a user's routine. The deviation determination unit 208 can make this determination by accessing the parameter database 204, as well as other databases that may contain user information. The alert database 206 includes possible alerts. For example, the alert database 206 can include a list of all possible alerts and what conditions prompt each of the alerts. In some embodiments, the alert database 206, or another database (e.g., a dedicated user database) can include alerts, and recipients, associated with each user. The users can configure what types of alerts should be associated with different types of deviations as well as who the recipient should be for each deviation. Additionally, some or all of the alerts and recipients can be standardized or preconfigured for the users. After the deviation determination unit 208 determines that the user has deviated from his or her routine, the alert determination unit 210 determines an appropriate alert. Additionally, the alert determination unit 210 can determine the appropriate recipient for the alert. The transmitter 218 then transmits the alert to the recipient device 216.

Figure 3:
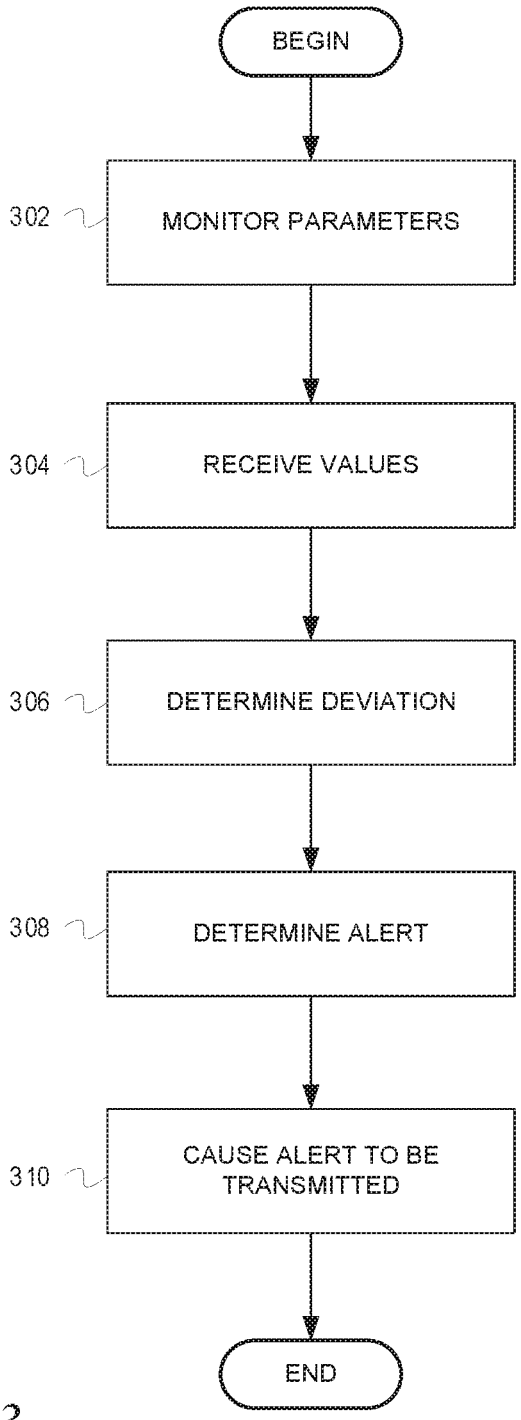
FIG. 3 is a flow chart depicting example operations for detecting a deviation in a person's activity, according to some embodiments.

While FIG. 2 and the related text describe an example system that can detect deviations from a person's normal routine and transmit alerts based on the deviations, FIG. 3 and the related text describe example operations for performed by such a system.

FIG. 3 is a flow chart depicting example operations for detecting a deviation in a person's activity, according to some embodiments. The flow begins at block 302.

At block 302, parameters are monitored. For example, a plurality of sensors monitors parameters that are associated with a person and his or her environment and activities. The plurality of sensors can include sensors that monitor the person and his or her activity and location as well as sensors within the person home or car that monitor the person's environment. The flow continues at block 304.

At block 304, values are received. For example, a control circuit can receive the values from one or more of the plurality of sensors. The values can be associated with the parameters monitored by the plurality of sensors. For example, the values can indicate information about the person such as his or her heartrate, blood pressure, body temperature, current activity, past activity, location, etc. The values can also indicate information about the person's environment such as room temperature, appliance usage, cabinet or refrigerator contents, energy usage, noise level, humidity level, occupants, etc. The flow continues at block 306.

At block 306, a deviation is determined. For example, the control circuit can determine that there has been a deviation from the person's routine. The control circuit can determine deviations based on a single value, for example, being above a threshold, below a threshold, out of range, etc. Additionally, in some embodiments, the control circuit can determine deviations based on multiple values. For example, each of the multiple values may be above or below a threshold or out of range. As another example, each of the multiple values may be within a normal or expected range, but the values in the aggregate may indicate a deviation. For example, the values may indicate that the person's pulse is 140 BPM and that the person is not currently engaged in physical exercise. While a heartrate of 140 BPM is high, it is not necessarily outside of a normal range and may not be out the person's normal or expected range. Additionally, that the person is not currently engaged in physical activity is not abnormal. However, the relatively high heartrate coupled with the lack of physical exercise may be a deviation that indicates a problem. In some embodiments, the control circuit references only the person's information to determine if there is a deviation. In other embodiments, the control circuit can aggregate data over time and from any number of users to determine trends in a larger population. In such embodiments, the control circuit can use this aggregated information to determine if there is a deviation. The flow continues at block 308.

At block 308, an alert is determined. For example, the control circuit can determine a type of alert. The type of alert can be based on the deviation and/or the values. More specifically, the type of alert can be based on the magnitude of the variance in the values from their expected value. For example, if the person typically gets out of bed at 7 A, at 9 A the control circuit may simply select an alert such as a wakeup call to the person. However, if the person typically gets out of bed at 7 A and it is 9 P, the control circuit may select an alert to notify a local police department to request a wellness check. The control circuit can also determine a recipient for the alert. The recipients can include the person, family members, friends, emergency personnel, retailers, etc. The control circuit can determine a recipient based upon user specifications, data from other users, preset configurations, etc. The control circuit can also determine a mode of transmission of the alert. For example, the alert can be a phone (e.g., voice) call, a text message, an email, a page, a social media message, a product shipment, etc. For example, if the control circuit determines that the person typically has pasta with dinner on Tuesdays, leaves the office around 6 P, and that there is not sufficient pasta in the person's home to support this meal, the alert can be an order to a retailer for more pasta. The flow continues at block 310.

At block 310, the alert is transmitted. For example, the control circuit can cause transmission of the alert. The control circuit can cause transmission of the alert by sending the alert, or providing a signal (e.g., including the alert and instructions) to a transmitter.

While the discussion of FIGS. 1-3 provides detail regarding monitoring a person's activity, detecting a deviation, and transmitting an alert based on the deviation, the discussion of FIGS. 4-20 provides additional detail regarding a person's values and generating a vector representation of the person's values.

Generally speaking, many of these embodiments provide for a memory having information stored therein that includes partiality information for each of a plurality of persons in the form of a plurality of partiality vectors for each of the persons wherein each partiality vector has at least one of a magnitude and an angle that corresponds to a magnitude of the person's belief in an amount of good that comes from an order associated with that partiality. This memory can also contain vectorized characterizations for each of a plurality of products, wherein each of the vectorized characterizations includes a measure regarding an extent to which a corresponding one of the products accords with a corresponding one of the plurality of partiality vectors.

Rules can then be provided that use the aforementioned information in support of a wide variety of activities and results. Although the described vector-based approaches bear little resemblance (if any) (conceptually or in practice) to prior approaches to understanding and/or metricizing a given person's product/service requirements, these approaches yield numerous benefits including, at least in some cases, reduced memory requirements, an ability to accommodate (both initially and dynamically over time) an essentially endless number and variety of partialities and/or product attributes, and processing/comparison capabilities that greatly ease computational resource requirements and/or greatly reduced time-to-solution results.

So configured, these teachings can constitute, for example, a method for automatically correlating a particular product with a particular person by using a control circuit to obtain a set of rules that define the particular product from amongst a plurality of candidate products for the particular person as a function of vectorized representations of partialities for the particular person and vectorized characterizations for the candidate products. This control circuit can also obtain partiality information for the particular person in the form of a plurality of partiality vectors that each have at least one of a magnitude and an angle that corresponds to a magnitude of the particular person's belief in an amount of good that comes from an order associated with that partiality and vectorized characterizations for each of the candidate products, wherein each of the vectorized characterizations indicates a measure regarding an extent to which a corresponding one of the candidate products accords with a corresponding one of the plurality of partiality vectors. The control circuit can then generate an output comprising identification of the particular product by evaluating the partiality vectors and the vectorized characterizations against the set of rules.

The aforementioned set of rules can include, for example, comparing at least some of the partiality vectors for the particular person to each of the vectorized characterizations for each of the candidate products using vector dot product calculations. By another approach, in lieu of the foregoing or in combination therewith, the aforementioned set of rules can include using the partiality vectors and the vectorized characterizations to define a plurality of solutions that collectively form a multi-dimensional surface and selecting the particular product from the multi-dimensional surface. In such a case the set of rules can further include accessing other information (such as objective information) for the particular person comprising information other than partiality vectors and using the other information to constrain a selection area on the multi-dimensional surface from which the particular product can be selected.

People tend to be partial to ordering various aspects of their lives, which is to say, people are partial to having things well arranged per their own personal view of how things should be. As a result, anything that contributes to the proper ordering of things regarding which a person has partialities represents value to that person. Quite literally, improving order reduces entropy for the corresponding person (i.e., a reduction in the measure of disorder present in that particular aspect of that person's life) and that improvement in order/reduction in disorder is typically viewed with favor by the affected person.

Generally speaking a value proposition must be coherent (logically sound) and have "force." Here, force takes the form of an imperative. When the parties to the imperative have a reputation of being trustworthy and the value proposition is perceived to yield a good outcome, then the imperative becomes anchored in the center of a belief that "this is something that I must do because the results will be good for me." With the imperative so anchored, the corresponding material space can be viewed as conforming to the order specified in the proposition that will result in the good outcome.

Pursuant to these teachings a belief in the good that comes from imposing a certain order takes the form of a value proposition. It is a set of coherent logical propositions by a trusted source that, when taken together, coalesce to form an imperative that a person has a personal obligation to order their lives because it will return a good outcome which improves their quality of life. This imperative is a value force that exerts the physical force (effort) to impose the desired order. The inertial effects come from the strength of the belief. The strength of the belief comes from the force of the value argument (proposition). And the force of the value proposition is a function of the perceived good and trust in the source that convinced the person's belief system to order material space accordingly. A belief remains constant until acted upon by a new force of a trusted value argument. This is at least a significant reason why the routine in people's lives remains relatively constant.

Newton's three laws of motion have a very strong bearing on the present teachings. Stated summarily, Newton's first law holds that an object either remains at rest or continues to move at a constant velocity unless acted upon by a force, the second law holds that the vector sum of the forces F on an object equal the mass m of that object multiplied by the acceleration a of the object (i.e., F=ma), and the third law holds that when one body exerts a force on a second body, the second body simultaneously exerts a force equal in magnitude and opposite in direction on the first body.

Relevant to both the present teachings and Newton's first law, beliefs can be viewed as having inertia. In particular, once a person believes that a particular order is good, they tend to persist in maintaining that belief and resist moving away from that belief. The stronger that belief the more force an argument and/or fact will need to move that person away from that belief to a new belief.

Relevant to both the present teachings and Newton's second law, the "force" of a coherent argument can be viewed as equaling the "mass" which is the perceived Newtonian effort to impose the order that achieves the aforementioned belief in the good which an imposed order brings multiplied by the change in the belief of the good which comes from the imposition of that order. Consider that when a change in the value of a particular order is observed then there must have been a compelling value claim influencing that change. There is a proportionality in that the greater the change the stronger the value argument. If a person values a particular activity and is very diligent to do that activity even when facing great opposition, we say they are dedicated, passionate, and so forth. If they stop doing the activity, it begs the question, what made them stop? The answer to that question needs to carry enough force to account for the change.

And relevant to both the present teachings and Newton's third law, for every effort to impose good order there is an equal and opposite good reaction.

Figure 4:
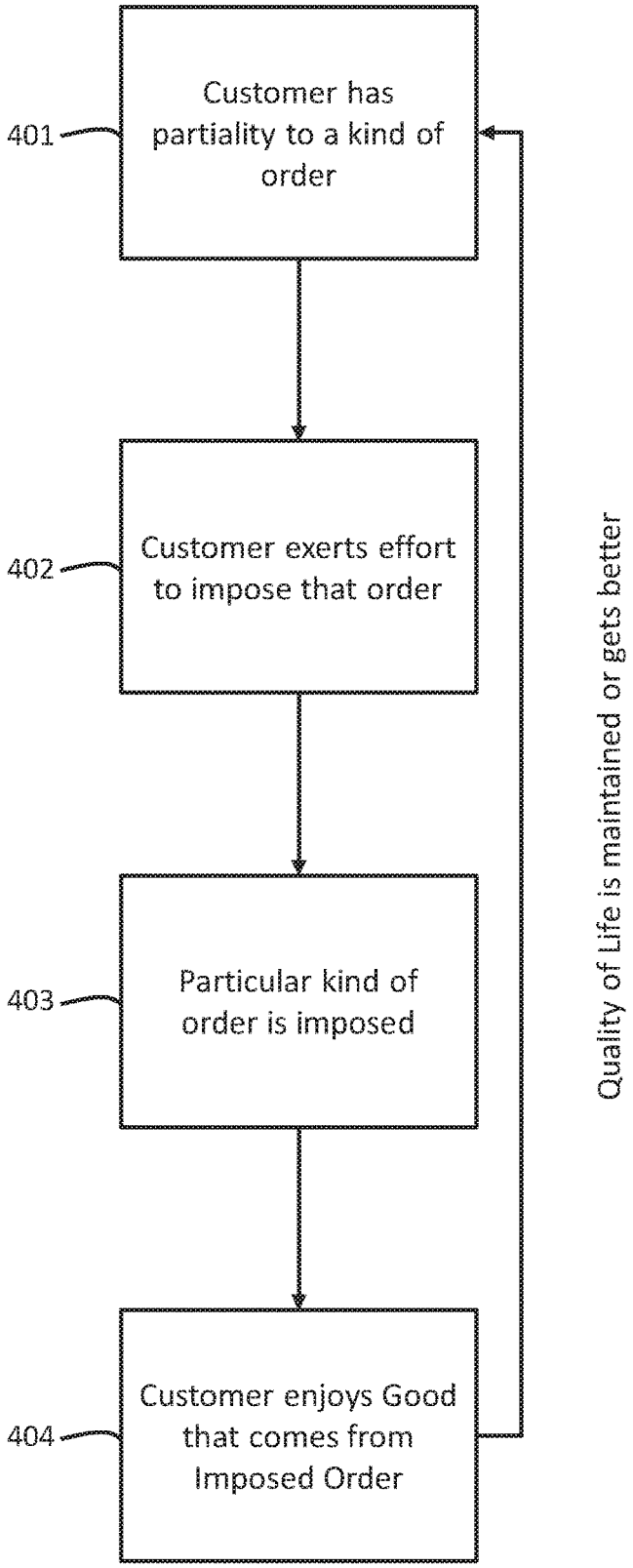
FIG. 4 comprises a flow diagram as configured in accordance with various embodiments of these teachings.

FIG. 4 provides a simple illustrative example in these regards. At block 401 it is understood that a particular person has a partiality (to a greater or lesser extent) to a particular kind of order. At block 402 that person willingly exerts effort to impose that order to thereby, at block 403, achieve an arrangement to which they are partial. And at block 404, this person appreciates the "good" that comes from successfully imposing the order to which they are partial, in effect establishing a positive feedback loop.

Figure 5:
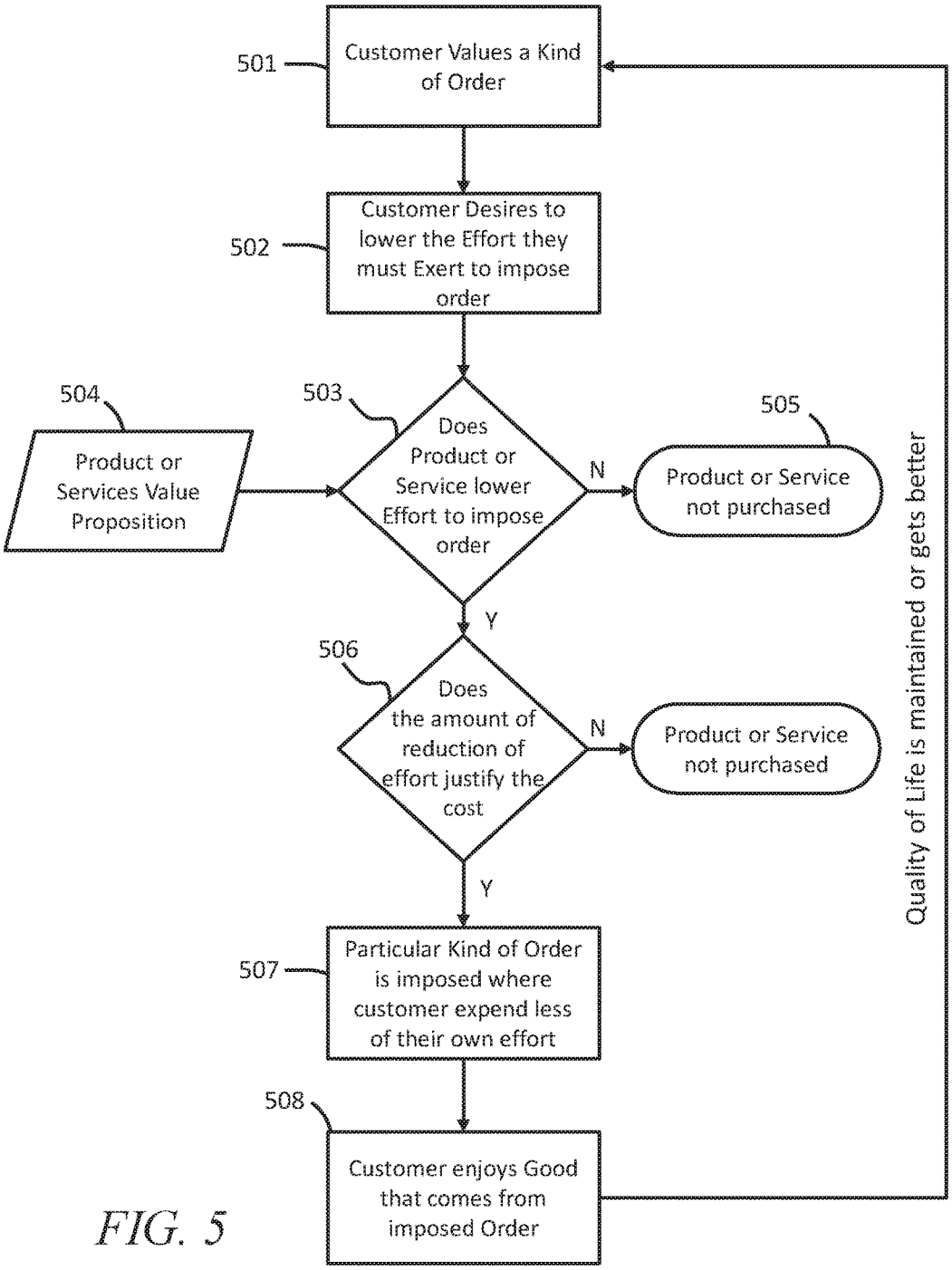
FIG. 5 comprises a flow diagram as configured in accordance with various embodiments of these teachings.

Understanding these partialities to particular kinds of order can be helpful to understanding how receptive a particular person may be to purchasing a given product or service. FIG. 5 provides a simple illustrative example in these regards. At block 501 it is understood that a particular person values a particular kind of order. At block 502 it is understood (or at least presumed) that this person wishes to lower the effort (or is at least receptive to lowering the effort) that they must personally exert to impose that order. At decision block 503 (and with access to information 504 regarding relevant products and or services) a determination can be made whether a particular product or service lowers the effort required by this person to impose the desired order. When such is not the case, it can be concluded that the person will not likely purchase such a product/service 505 (presuming better choices are available).

When the product or service does lower the effort required to impose the desired order, however, at block 506 a determination can be made as to whether the amount of the reduction of effort justifies the cost of purchasing and/or using the proffered product/service. If the cost does not justify the reduction of effort, it can again be concluded that the person will not likely purchase such a product/service 505. When the reduction of effort does justify the cost, however, this person may be presumed to want to purchase the product/service and thereby achieve the desired order (or at least an improvement with respect to that order) with less expenditure of their own personal effort (block 507) and thereby achieve, at block 508, corresponding enjoyment or appreciation of that result.

To facilitate such an analysis, the applicant has determined that factors pertaining to a person's partialities can be quantified and otherwise represented as corresponding vectors (where "vector" will be understood to refer to a geometric object/quantity having both an angle and a length/magnitude). These teachings will accommodate a variety of differing bases for such partialities including, for example, a person's values, affinities, aspirations, and preferences.

A value is a person's principle or standard of behavior, their judgment of what is important in life. A person's values represent their ethics, moral code, or morals and not a mere unprincipled liking or disliking of something. A person's value might be a belief in kind treatment of animals, a belief in cleanliness, a belief in the importance of personal care, and so forth.

An affinity is an attraction (or even a feeling of kinship) to a particular thing or activity. Examples including such a feeling towards a participatory sport such as golf or a spectator sport (including perhaps especially a particular team such as a particular professional or college football team), a hobby (such as quilting, model railroading, and so forth), one or more components of popular culture (such as a particular movie or television series, a genre of music or a particular musical performance group, or a given celebrity, for example), and so forth.

"Aspirations" refer to longer-range goals that require months or even years to reasonably achieve. As used herein "aspirations" does not include mere short-term goals (such as making a particular meal tonight or driving to the store and back without a vehicular incident). The aspired-to goals, in turn, are goals pertaining to a marked elevation in one's core competencies (such as an aspiration to master a particular game such as chess, to achieve a particular articulated and recognized level of martial arts proficiency, or to attain a particular articulated and recognized level of cooking proficiency), professional status (such as an aspiration to receive a particular advanced education degree, to pass a professional examination such as a state Bar examination of a Certified Public Accountants examination, or to become Board certified in a particular area of medical practice), or life experience milestone (such as an aspiration to climb Mount Everest, to visit every state capital, or to attend a game at every major league baseball park in the United States). It will further be understood that the goal(s) of an aspiration is not something that can likely merely simply happen of its own accord; achieving an aspiration requires an intelligent effort to order one's life in a way that increases the likelihood of actually achieving the corresponding goal or goals to which that person aspires. One aspires to one day run their own business as versus, for example, merely hoping to one day win the state lottery.

A preference is a greater liking for one alternative over another or others. A person can prefer, for example, that their steak is cooked "medium" rather than other alternatives such as "rare" or "well done" or a person can prefer to play golf in the morning rather than in the afternoon or evening. Preferences can and do come into play when a given person makes purchasing decisions at a retail shopping facility. Preferences in these regards can take the form of a preference for a particular brand over other available brands or a preference for economy-sized packaging as versus, say, individual serving-sized packaging.

Values, affinities, aspirations, and preferences are not necessarily wholly unrelated. It is possible for a person's values, affinities, or aspirations to influence or even dictate their preferences in specific regards. For example, a person's moral code that values non-exploitive treatment of animals may lead them to prefer foods that include no animal-based ingredients and hence to prefer fruits and vegetables over beef and chicken offerings. As another example, a person's affinity for a particular musical group may lead them to prefer clothing that directly or indirectly references or otherwise represents their affinity for that group. As yet another example, a person's aspirations to become a Certified Public Accountant may lead them to prefer business-related media content.

While a value, affinity, or aspiration may give rise to or otherwise influence one or more corresponding preferences, however, is not to say that these things are all one and the same; they are not. For example, a preference may represent either a principled or an unprincipled liking for one thing over another, while a value is the principle itself. Accordingly, as used herein it will be understood that a partiality can include, in context, any one or more of a value-based, affinity-based, aspiration-based, and/or preference-based partiality unless one or more such features is specifically excluded per the needs of a given application setting.

Information regarding a given person's partialities can be acquired using any one or more of a variety of information-gathering and/or analytical approaches. By one simple approach, a person may voluntarily disclose information regarding their partialities (for example, in response to an online questionnaire or survey or as part of their social media presence). By another approach, the purchasing history for a given person can be analyzed to intuit the partialities that led to at least some of those purchases. By yet another approach demographic information regarding a particular person can serve as yet another source that sheds light on their partialities. Other ways that people reveal how they order their lives include but are not limited to: (1) their social networking profiles and behaviors (such as the things they "like" via Facebook, the images they post via Pinterest, informal and formal comments they initiate or otherwise provide in response to third-party postings including statements regarding their own personal long-term goals, the persons/topics they follow via Twitter, the photographs they publish via Picasso, and so forth); (2) their Internet surfing history; (3) their on-line or otherwise-published affinity-based memberships; (4) real-time (or delayed) information (such as steps walked, calories burned, geographic location, activities experienced, and so forth) from any of a variety of personal sensors (such as smart phones, tablet/pad-styled computers, fitness wearables, Global Positioning System devices, and so forth) and the so-called Internet of Things (such as smart refrigerators and pantries, entertainment and information platforms, exercise and sporting equipment, and so forth); (5) instructions, selections, and other inputs (including inputs that occur within augmented-reality user environments) made by a person via any of a variety of interactive interfaces (such as keyboards and cursor control devices, voice recognition, gesture-based controls, and eye tracking-based controls), and so forth.

The present teachings employ a vector-based approach to facilitate characterizing, representing, understanding, and leveraging such partialities to thereby identify products (and/or services) that will, for a particular corresponding consumer, provide for an improved or at least a favorable corresponding ordering for that consumer. Vectors are directed quantities that each have both a magnitude and a direction. Per the applicant's approach these vectors have a real, as versus a metaphorical, meaning in the sense of Newtonian physics. Generally speaking, each vector represents order imposed upon material space-time by a particular partiality.

Figure 6:
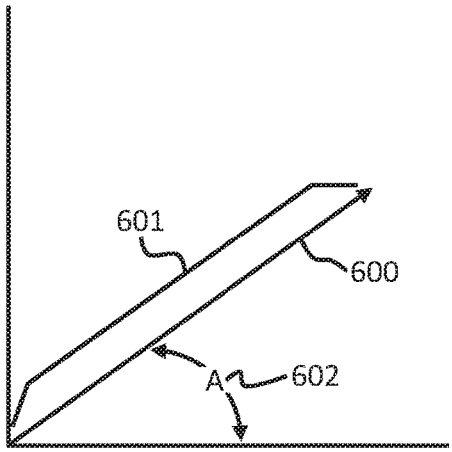
FIG. 6 comprises a graphic representation as configured in accordance with various embodiments of these teachings.

FIG. 6 provides some illustrative examples in these regards. By one approach the vector 600 has a corresponding magnitude 601 (i.e., length) that represents the magnitude of the strength of the belief in the good that comes from that imposed order (which belief, in turn, can be a function, relatively speaking, of the extent to which the order for this particular partiality is enabled and/or achieved). In this case, the greater the magnitude 601, the greater the strength of that belief and vice versa. Per another example, the vector 600 has a corresponding angle A 602 that instead represents the foregoing magnitude of the strength of the belief (and where, for example, an angle of 0° represents no such belief and an angle of 90° represents a highest magnitude in these regards, with other ranges being possible as desired).

Accordingly, a vector serving as a partiality vector can have at least one of a magnitude and an angle that corresponds to a magnitude of a particular person's belief in an amount of good that comes from an order associated with a particular partiality.

Applying force to displace an object with mass in the direction of a certain partiality-based order creates worth for a person who has that partiality. The resultant work (i.e., that force multiplied by the distance the object moves) can be viewed as a worth vector having a magnitude equal to the accomplished work and having a direction that represents the corresponding imposed order. If the resultant displacement results in more order of the kind that the person is partial to then the net result is a notion of "good." This "good" is a real quantity that exists in meta-physical space much like work is a real quantity in material space. The link between the "good" in meta-physical space and the work in material space is that it takes work to impose order that has value.

In the context of a person, this effort can represent, quite literally, the effort that the person is willing to exert to be compliant with (or to otherwise serve) this particular partiality. For example, a person who values animal rights would have a large magnitude worth vector for this value if they exerted considerable physical effort towards this cause by, for example, volunteering at animal shelters or by attending protests of animal cruelty.

While these teachings will readily employ a direct measurement of effort such as work done or time spent, these teachings will also accommodate using an indirect measurement of effort such as expense; in particular, money. In many cases people trade their direct labor for payment. The labor may be manual or intellectual. While salaries and payments can vary significantly from one person to another, a same sense of effort applies at least in a relative sense.

As a very specific example in these regards, there are wristwatches that require a skilled craftsman over a year to make. The actual aggregated amount of force applied to displace the small components that comprise the wristwatch would be relatively very small. That said, the skilled craftsman acquired the necessary skill to so assemble the wristwatch over many years of applying force to displace thousands of little parts when assembly previous wristwatches. That experience, based upon a much larger aggregation of previously-exerted effort, represents a genuine part of the "effort" to make this particular wristwatch and hence is fairly considered as part of the wristwatch's worth.

The conventional forces working in each person's mind are typically more-or-less constantly evaluating the value propositions that correspond to a path of least effort to thereby order their lives towards the things they value. A key reason that happens is because the actual ordering occurs in material space and people must exert real energy in pursuit of their desired ordering. People therefore naturally try to find the path with the least real energy expended that still moves them to the valued order. Accordingly, a trusted value proposition that offers a reduction of real energy will be embraced as being "good" because people will tend to be partial to anything that lowers the real energy they are required to exert while remaining consistent with their partialities.

Figure 7:
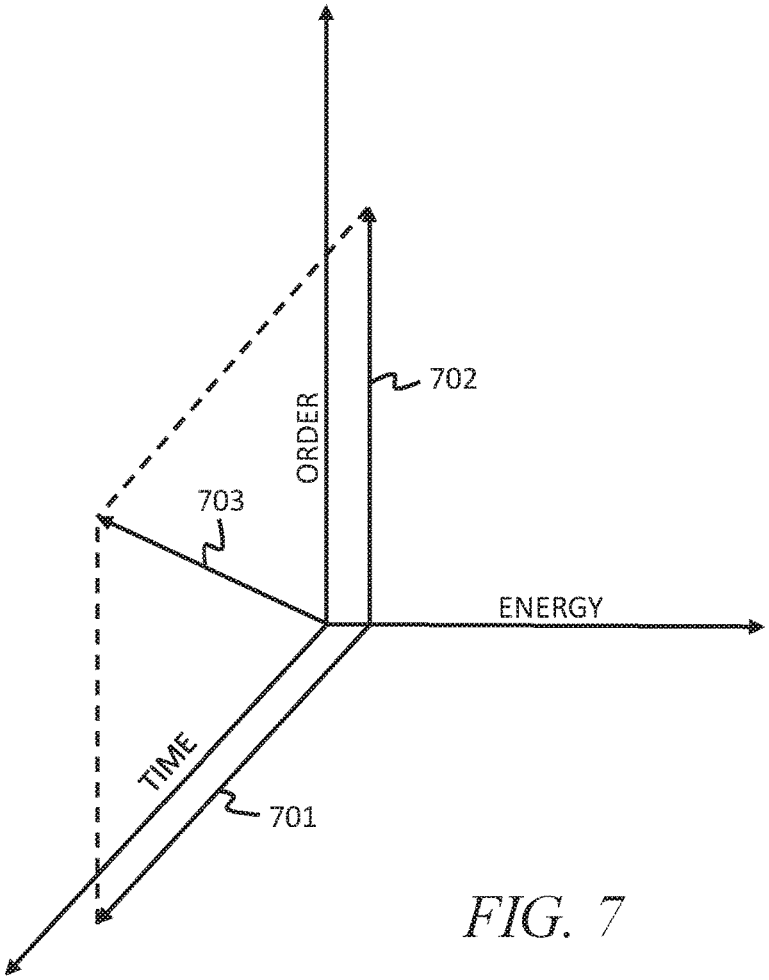
FIG. 7 comprises a graph as configured in accordance with various embodiments of these teachings.

FIG. 7 presents a space graph that illustrates many of the foregoing points. A first vector 701 represents the time required to make such a wristwatch while a second vector 702 represents the order associated with such a device (in this case, that order essentially represents the skill of the craftsman). These two vectors 701 and 702 in turn sum to form a third vector 703 that constitutes a value vector for this wristwatch. This value vector 703, in turn, is offset with respect to energy (i.e., the energy associated with manufacturing the wristwatch).

A person partial to precision and/or to physically presenting an appearance of success and status (and who presumably has the wherewithal) may, in turn, be willing to spend $100,000 for such a wristwatch. A person able to afford such a price, of course, may themselves be skilled at imposing a certain kind of order that other persons are partial to such that the amount of physical work represented by each spent dollar is small relative to an amount of dollars they receive when exercising their skill(s). (Viewed another way, wearing an expensive wristwatch may lower the effort required for such a person to communicate that their own personal success comes from being highly skilled in a certain order of high worth.)

Generally speaking, all worth comes from imposing order on the material space-time. The worth of a particular order generally increases as the skill required to impose the order increases. Accordingly, unskilled labor may exchange $10 for every hour worked where the work has a high content of unskilled physical labor while a highly-skilled data scientist may exchange $75 for every hour worked with very little accompanying physical effort.

Consider a simple example where both of these laborers are partial to a well-ordered lawn and both have a corresponding partiality vector in those regards with a same magnitude. To observe that partiality the unskilled laborer may own an inexpensive push power lawn mower that this person utilizes for an hour to mow their lawn. The data scientist, on the other hand, pays someone else $75 in this example to mow their lawn. In both cases these two individuals traded one hour of worth creation to gain the same worth (to them) in the form of a well-ordered lawn; the unskilled laborer in the form of direct physical labor and the data scientist in the form of money that required one hour of their specialized effort to earn.

This same vector-based approach can also represent various products and services. This is because products and services have worth (or not) because they can remove effort (or fail to remove effort) out of the customer's life in the direction of the order to which the customer is partial. In particular, a product has a perceived effort embedded into each dollar of cost in the same way that the customer has an amount of perceived effort embedded into each dollar earned. A customer has an increased likelihood of responding to an exchange of value if the vectors for the product and the customer's partiality are directionally aligned and where the magnitude of the vector as represented in monetary cost is somewhat greater than the worth embedded in the customer's dollar.

Put simply, the magnitude (and/or angle) of a partiality vector for a person can represent, directly or indirectly, a corresponding effort the person is willing to exert to pursue that partiality. There are various ways by which that value can be determined. As but one non-limiting example in these regards, the magnitude/angle V of a particular partiality vector can be expressed as:

$$V = \begin{bmatrix} X_1 \\ \vdots \\ X_n \end{bmatrix} [W_1 \ldots W_n]$$

where X refers to any of a variety of inputs (such as those described above) that can impact the characterization of a particular partiality (and where these teachings will accommodate either or both subjective and objective inputs as desired) and W refers to weighting factors that are appropriately applied the foregoing input values (and where, for example, these weighting factors can have values that themselves reflect a particular person's consumer personality or otherwise as desired and can be static or dynamically valued in practice as desired).

In the context of a product (or service) the magnitude/angle of the corresponding vector can represent the reduction of effort that must be exerted when making use of this product to pursue that partiality, the effort that was expended in order to create the product/service, the effort that the person perceives can be personally saved while nevertheless promoting the desired order, and/or some other corresponding effort. Taken as a whole the sum of all the vectors must be perceived to increase the overall order to be considered a good product/service.

It may be noted that while reducing effort provides a very useful metric in these regards, it does not necessarily follow that a given person will always gravitate to that which most reduces effort in their life. This is at least because a given person's values (for example) will establish a baseline against which a person may eschew some goods/services that might in fact lead to a greater overall reduction of effort but which would conflict, perhaps fundamentally, with their values. As a simple illustrative example, a given person might value physical activity. Such a person could experience reduced effort (including effort represented via monetary costs) by simply sitting on their couch, but instead will pursue activities that involve that valued physical activity. That said, however, the goods and services that such a person might acquire in support of their physical activities are still likely to represent increased order in the form of reduced effort where that makes sense. For example, a person who favors rock climbing might also favor rock climbing clothing and supplies that render that activity safer to thereby reduce the effort required to prevent disorder as a consequence of a fall (and consequently increasing the good outcome of the rock climber's quality experience).

By forming reliable partiality vectors for various individuals and corresponding product characterization vectors for a variety of products and/or services, these teachings provide a useful and reliable way to identify products/services that accord with a given person's own partialities (whether those partialities are based on their values, their affinities, their preferences, or otherwise).

It is of course possible that partiality vectors may not be available yet for a given person due to a lack of sufficient specific source information from or regarding that person. In this case it may nevertheless be possible to use one or more partiality vector templates that generally represent certain groups of people that fairly include this particular person. For example, if the person's gender, age, academic status/achievements, and/or postal code are known it may be useful to utilize a template that includes one or more partiality vectors that represent some statistical average or norm of other persons matching those same characterizing parameters. (Of course, while it may be useful to at least begin to employ these teachings with certain individuals by using one or more such templates, these teachings will also accommodate modifying (perhaps significantly and perhaps quickly) such a starting point over time as part of developing a more personal set of partiality vectors that are specific to the individual.) A variety of templates could be developed based, for example, on professions, academic pursuits and achievements, nationalities and/or ethnicities, characterizing hobbies, and the like.

Figure 8:
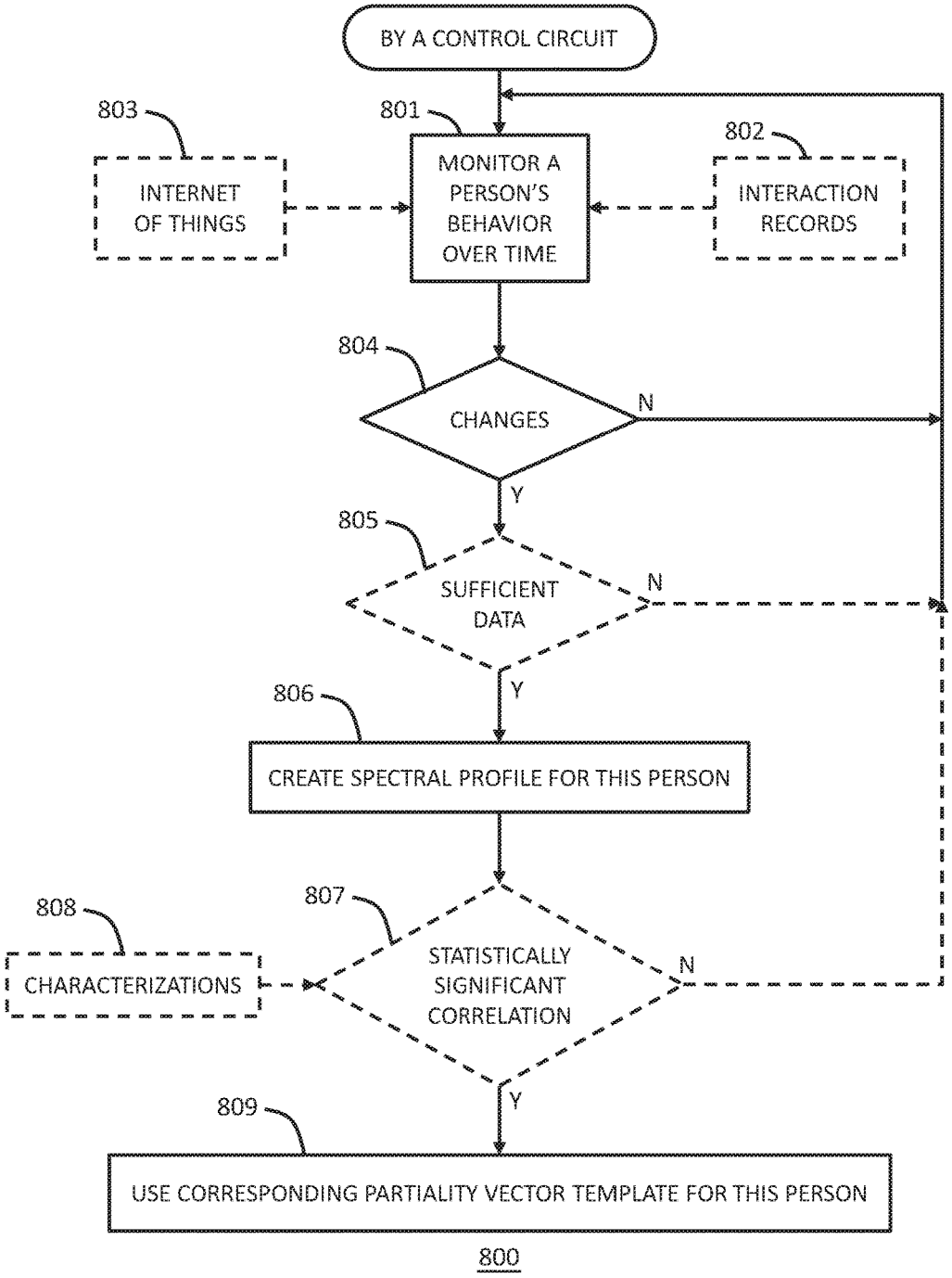
FIG. 8 comprises a flow diagram as configured in accordance with various embodiments of these teachings.

FIG. 8 presents a process 800 that illustrates yet another approach in these regards. For the sake of an illustrative example it will be presumed here that a control circuit of choice (with useful examples in these regards being presented further below) carries out one or more of the described steps/actions.

At block 801 the control circuit monitors a person's behavior over time. The range of monitored behaviors can vary with the individual and the application setting. By one approach, only behaviors that the person has specifically approved for monitoring are so monitored.

As one example in these regards, this monitoring can be based, in whole or in part, upon interaction records 802 that reflect or otherwise track, for example, the monitored person's purchases. This can include specific items purchased by the person, from whom the items were purchased, where the items were purchased, how the items were purchased (for example, at a bricks-and-mortar physical retail shopping facility or via an on-line shopping opportunity), the price paid for the items, and/or which items were returned and when), and so forth.

As another example in these regards the interaction records 802 can pertain to the social networking behaviors of the monitored person including such things as their "likes," their posted comments, images, and tweets, affinity group affiliations, their on-line profiles, their playlists and other indicated "favorites," and so forth. Such information can sometimes comprise a direct indication of a particular partiality or, in other cases, can indirectly point towards a particular partiality and/or indicate a relative strength of the person's partiality.

Other interaction records of potential interest include but are not limited to registered political affiliations and activities, credit reports, military-service history, educational and employment history, and so forth.

As another example, in lieu of the foregoing or in combination therewith, this monitoring can be based, in whole or in part, upon sensor inputs from the Internet of Things (IoT) 803. The Internet of Things refers to the Internet-based inter-working of a wide variety of physical devices including but not limited to wearable or carriable devices, vehicles, buildings, and other items that are embedded with electronics, software, sensors, network connectivity, and sometimes actuators that enable these objects to collect and exchange data via the Internet. In particular, the Internet of Things allows people and objects pertaining to people to be sensed and corresponding information to be transferred to remote locations via intervening network infrastructure. Some experts estimate that the Internet of Things will consist of almost 50 billion such objects by 2020. (Further description in these regards appears further herein.)

Depending upon what sensors a person encounters, information can be available regarding a person's travels, lifestyle, calorie expenditure over time, diet, habits, interests and affinities, choices and assumed risks, and so forth. This process 800 will accommodate either or both real-time or non-real time access to such information as well as either or both push and pull-based paradigms.

By monitoring a person's behavior over time, a general sense of that person's daily routine can be established (sometimes referred to herein as a routine experiential base state). As a very simple illustrative example, a routine experiential base state can include a typical daily event timeline for the person that represents typical locations that the person visits and/or typical activities in which the person engages. The timeline can indicate those activities that tend to be scheduled (such as the person's time at their place of employment or their time spent at their child's sports practices) as well as visits/activities that are normal for the person though not necessarily undertaken with strict observance to a corresponding schedule (such as visits to local stores, movie theaters, and the homes of nearby friends and relatives).

At block 804 this process 800 provides for detecting changes to that established routine. These teachings are highly flexible in these regards and will accommodate a wide variety of "changes." Some illustrative examples include but are not limited to changes with respect to a person's travel schedule, destinations visited or time spent at a particular destination, the purchase and/or use of new and/or different products or services, a subscription to a new magazine, a new Rich Site Summary (RSS) feed or a subscription to a new blog, a new "friend" or "connection" on a social networking site, a new person, entity, or cause to follow on a Twitter-like social networking service, enrollment in an academic program, and so forth.

Upon detecting a change, at optional block 805 this process 800 will accommodate assessing whether the detected change constitutes a sufficient amount of data to warrant proceeding further with the process. This assessment can comprise, for example, assessing whether a sufficient number (i.e., a predetermined number) of instances of this particular detected change have occurred over some predetermined period of time. As another example, this assessment can comprise assessing whether the specific details of the detected change are sufficient in quantity and/or quality to warrant further processing. For example, merely detecting that the person has not arrived at their usual 6 PM-Wednesday dance class may not be enough information, in and of itself, to warrant further processing, in which case the information regarding the detected change may be discarded or, in the alternative, cached for further consideration and use in conjunction or aggregation with other, later-detected changes.

Figure 9:
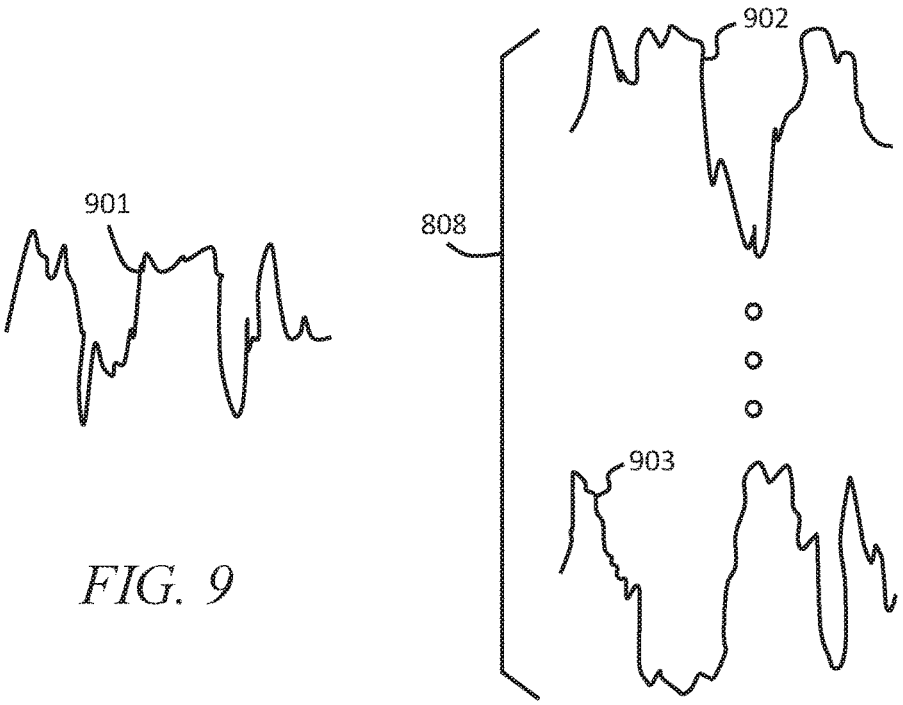
FIG. 9 comprises a graphic representation as configured in accordance with various embodiments of these teachings.

At block 807 this process 800 uses these detected changes to create a spectral profile for the monitored person. FIG. 9 provides an illustrative example in these regards with the spectral profile denoted by reference numeral 901. In this illustrative example the spectral profile 901 represents changes to the person's behavior over a given period of time (such as an hour, a day, a week, or some other temporal window of choice). Such a spectral profile can be as multidimensional as may suit the needs of a given application setting.

At optional block 807 this process 800 then provides for determining whether there is a statistically significant correlation between the aforementioned spectral profile and any of a plurality of like characterizations 808. The like characterizations 808 can comprise, for example, spectral profiles that represent an average of groupings of people who share many of the same (or all of the same) identified partialities. As a very simple illustrative example in these regards, a first such characterization 902 might represent a composite view of a first group of people who have three similar partialities but a dissimilar fourth partiality while another of the characterizations 903 might represent a composite view of a different group of people who share all four partialities.

The aforementioned "statistically significant" standard can be selected and/or adjusted to suit the needs of a given application setting. The scale or units by which this measurement can be assessed can be any known, relevant scale/unit including, but not limited to, scales such as standard deviations, cumulative percentages, percentile equivalents, Z-scores, T-scores, standard nines, and percentages in standard nines. Similarly, the threshold by which the level of statistical significance is measured/assessed can be set and selected as desired. By one approach the threshold is static such that the same threshold is employed regardless of the circumstances. By another approach the threshold is dynamic and can vary with such things as the relative size of the population of people upon which each of the characterizations 808 are based and/or the amount of data and/or the duration of time over which data is available for the monitored person.

Figure 10:
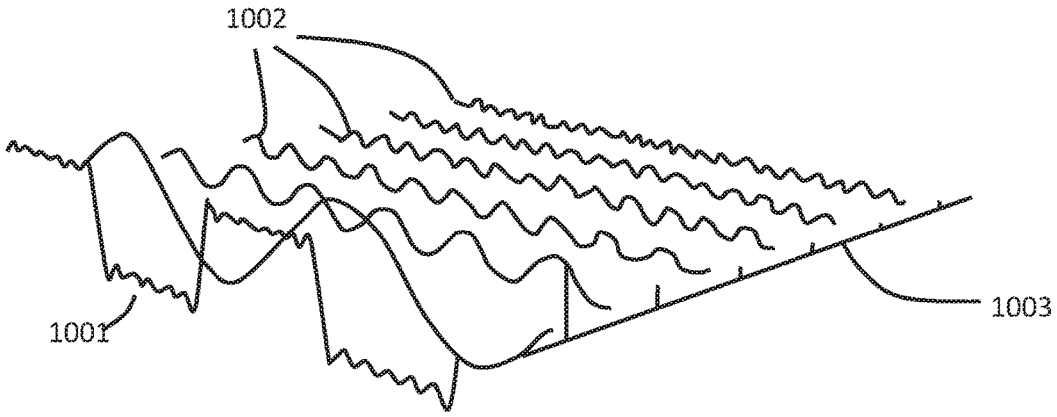
FIG. 10 comprises a graphic representation as configured in accordance with various embodiments of these teachings.

Referring now to FIG. 10, by one approach the selected characterization (denoted by reference numeral 1001 in this figure) comprises an activity profile over time of one or more human behaviors. Examples of behaviors include but are not limited to such things as repeated purchases over time of particular commodities, repeated visits over time to particular locales such as certain restaurants, retail outlets, athletic or entertainment facilities, and so forth, and repeated activities over time such as floor cleaning, dish washing, car cleaning, cooking, volunteering, and so forth. Those skilled in the art will understand and appreciate, however, that the selected characterization is not, in and of itself, demographic data (as described elsewhere herein).

More particularly, the characterization 1001 can represent (in this example, for a plurality of different behaviors) each instance over the monitored/sampled period of time when the monitored/represented person engages in a particular represented behavior (such as visiting a neighborhood gym, purchasing a particular product (such as a consumable perishable or a cleaning product), interacts with a particular affinity group via social networking, and so forth). The relevant overall time frame can be chosen as desired and can range in a typical application setting from a few hours or one day to many days, weeks, or even months or years. (It will be understood by those skilled in the art that the particular characterization shown in FIG. 10 is intended to serve an illustrative purpose and does not necessarily represent or mimic any particular behavior or set of behaviors).

Generally speaking it is anticipated that many behaviors of interest will occur at regular or somewhat regular intervals and hence will have a corresponding frequency or periodicity of occurrence. For some behaviors that frequency of occurrence may be relatively often (for example, oral hygiene events that occur at least once, and often multiple times each day) while other behaviors (such as the preparation of a holiday meal) may occur much less frequently (such as only once, or only a few times, each year). For at least some behaviors of interest that general (or specific) frequency of occurrence can serve as a significant indication of a person's corresponding partialities.

By one approach, these teachings will accommodate detecting and timestamping each and every event/activity/behavior or interest as it happens. Such an approach can be memory intensive and require considerable supporting infrastructure.

The present teachings will also accommodate, however, using any of a variety of sampling periods in these regards. In some cases, for example, the sampling period per se may be one week in duration. In that case, it may be sufficient to know that the monitored person engaged in a particular activity (such as cleaning their car) a certain number of times during that week without known precisely when, during that week, the activity occurred. In other cases it may be appropriate or even desirable, to provide greater granularity in these regards. For example, it may be better to know which days the person engaged in the particular activity or even the particular hour of the day. Depending upon the selected granularity/resolution, selecting an appropriate sampling window can help reduce data storage requirements (and/or corresponding analysis/processing overhead requirements).

Although a given person's behaviors may not, strictly speaking, be continuous waves (as shown in FIG. 10) in the same sense as, for example, a radio or acoustic wave, it will nevertheless be understood that such a behavioral characterization 1001 can itself be broken down into a plurality of sub-waves 1002 that, when summed together, equal or at least approximate to some satisfactory degree the behavioral characterization 1001 itself. (The more-discrete and sometimes less-rigidly periodic nature of the monitored behaviors may introduce a certain amount of error into the corresponding sub-waves. There are various mathematically satisfactory ways by which such error can be accommodated including by use of weighting factors and/or expressed tolerances that correspond to the resultant sub-waves.)

It should also be understood that each such sub-wave can often itself be associated with one or more corresponding discrete partialities. For example, a partiality reflecting concern for the environment may, in turn, influence many of the included behavioral events (whether they are similar or dissimilar behaviors or not) and accordingly may, as a sub-wave, comprise a relatively significant contributing factor to the overall set of behaviors as monitored over time. These sub-waves (partialities) can in turn be clearly revealed and presented by employing a transform (such as a Fourier transform) of choice to yield a spectral profile 1003 wherein the X axis represents frequency and the Y axis represents the magnitude of the response of the monitored person at each frequency/sub-wave of interest.

Figure 11:
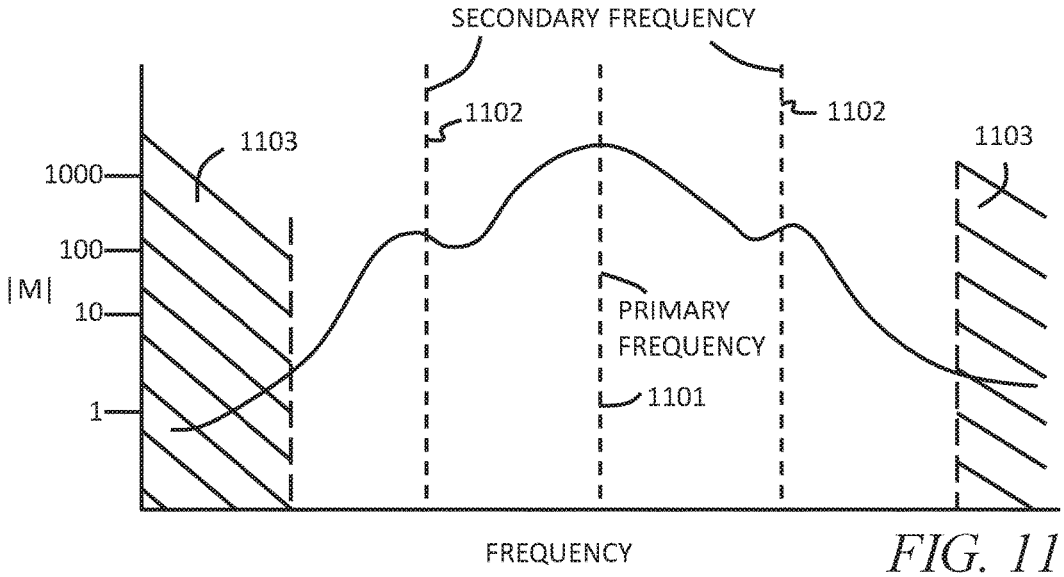
FIG. 11 comprises a graphic representation as configured in accordance with various embodiments of these teachings.

This spectral response of a given individual—which is generated from a time series of events that reflect/track that person's behavior—yields frequency response characteristics for that person that are analogous to the frequency response characteristics of physical systems such as, for example, an analog or digital filter or a second order electrical or mechanical system. Referring to FIG. 11, for many people the spectral profile of the individual person will exhibit a primary frequency 1101 for which the greatest response (perhaps many orders of magnitude greater than other evident frequencies) to life is exhibited and apparent. In addition, the spectral profile may also possibly identify one or more secondary frequencies 1102 above and/or below that primary frequency 1101. (It may be useful in many application settings to filter out more distant frequencies 1103 having considerably lower magnitudes because of a reduced likelihood of relevance and/or because of a possibility of error in those regards; in effect, these lower-magnitude signals constitute noise that such filtering can remove from consideration.)

As noted above, the present teachings will accommodate using sampling windows of varying size. By one approach the frequency of events that correspond to a particular partiality can serve as a basis for selecting a particular sampling rate to use when monitoring for such events. For example, Nyquist-based sampling rules (which dictate sampling at a rate at least twice that of the frequency of the signal of interest) can lead one to choose a particular sampling rate (and the resultant corresponding sampling window size).

As a simple illustration, if the activity of interest occurs only once a week, then using a sampling of half-a-week and sampling twice during the course of a given week will adequately capture the monitored event. If the monitored person's behavior should change, a corresponding change can be automatically made. For example, if the person in the foregoing example begins to engage in the specified activity three times a week, the sampling rate can be switched to six times per week (in conjunction with a sampling window that is resized accordingly).

By one approach, the sampling rate can be selected and used on a partiality-by-partiality basis. This approach can be especially useful when different monitoring modalities are employed to monitor events that correspond to different partialities. If desired, however, a single sampling rate can be employed and used for a plurality (or even all) partialities/behaviors. In that case, it can be useful to identify the behavior that is exemplified most often (i.e., that behavior which has the highest frequency) and then select a sampling rate that is at least twice that rate of behavioral realization, as that sampling rate will serve well and suffice for both that highest-frequency behavior and all lower-frequency behaviors as well.

It can be useful in many application settings to assume that the foregoing spectral profile of a given person is an inherent and inertial characteristic of that person and that this spectral profile, in essence, provides a personality profile of that person that reflects not only how but why this person responds to a variety of life experiences. More importantly, the partialities expressed by the spectral profile for a given person will tend to persist going forward and will not typically change significantly in the absence of some powerful external influence (including but not limited to significant life events such as, for example, marriage, children, loss of job, promotion, and so forth).

In any event, by knowing a priori the particular partialities (and corresponding strengths) that underlie the particular characterization 1001, those partialities can be used as an initial template for a person whose own behaviors permit the selection of that particular characterization 1001. In particular, those particularities can be used, at least initially, for a person for whom an amount of data is not otherwise available to construct a similarly rich set of partiality information.

As a very specific and non-limiting example, per these teachings the choice to make a particular product can include consideration of one or more value systems of potential customers. When considering persons who value animal rights, a product conceived to cater to that value proposition may require a corresponding exertion of additional effort to order material space-time such that the product is made in a way that (A) does not harm animals and/or (even better) (B) improves life for animals (for example, eggs obtained from free range chickens). The reason a person exerts effort to order material space-time is because they believe it is good to do and/or not good to not do so. When a person exerts effort to do good (per their personal standard of "good") and if that person believes that a particular order in material space-time (that includes the purchase of a particular product) is good to achieve, then that person will also believe that it is good to buy as much of that particular product (in order to achieve that good order) as their finances and needs reasonably permit (all other things being equal).

The aforementioned additional effort to provide such a product can (typically) convert to a premium that adds to the price of that product. A customer who puts out extra effort in their life to value animal rights will typically be willing to pay that extra premium to cover that additional effort exerted by the company. By one approach a magnitude that corresponds to the additional effort exerted by the company can be added to the person's corresponding value vector because a product or service has worth to the extent that the product/service allows a person to order material space-time in accordance with their own personal value system while allowing that person to exert less of their own effort in direct support of that value (since money is a scalar form of effort).

By one approach there can be hundreds or even thousands of identified partialities. In this case, if desired, each product/service of interest can be assessed with respect to each and every one of these partialities and a corresponding partiality vector formed to thereby build a collection of partiality vectors that collectively characterize the product/service. As a very simple example in these regards, a given laundry detergent might have a cleanliness partiality vector with a relatively high magnitude (representing the effectiveness of the detergent), a ecology partiality vector that might be relatively low or possibly even having a negative magnitude (representing an ecologically disadvantageous effect of the detergent post usage due to increased disorder in the environment), and a simple-life partiality vector with only a modest magnitude (representing the relative ease of use of the detergent but also that the detergent presupposes that the user has a modern washing machine). Other partiality vectors for this detergent, representing such things as nutrition or mental acuity, might have magnitudes of zero.

As mentioned above, these teachings can accommodate partiality vectors having a negative magnitude. Consider, for example, a partiality vector representing a desire to order things to reduce one's so-called carbon footprint. A magnitude of zero for this vector would indicate a completely neutral effect with respect to carbon emissions while any positive-valued magnitudes would represent a net reduction in the amount of carbon in the atmosphere, hence increasing the ability of the environment to be ordered. Negative magnitudes would represent the introduction of carbon emissions that increases disorder of the environment (for example, as a result of manufacturing the product, transporting the product, and/or using the product)

Figure 12:
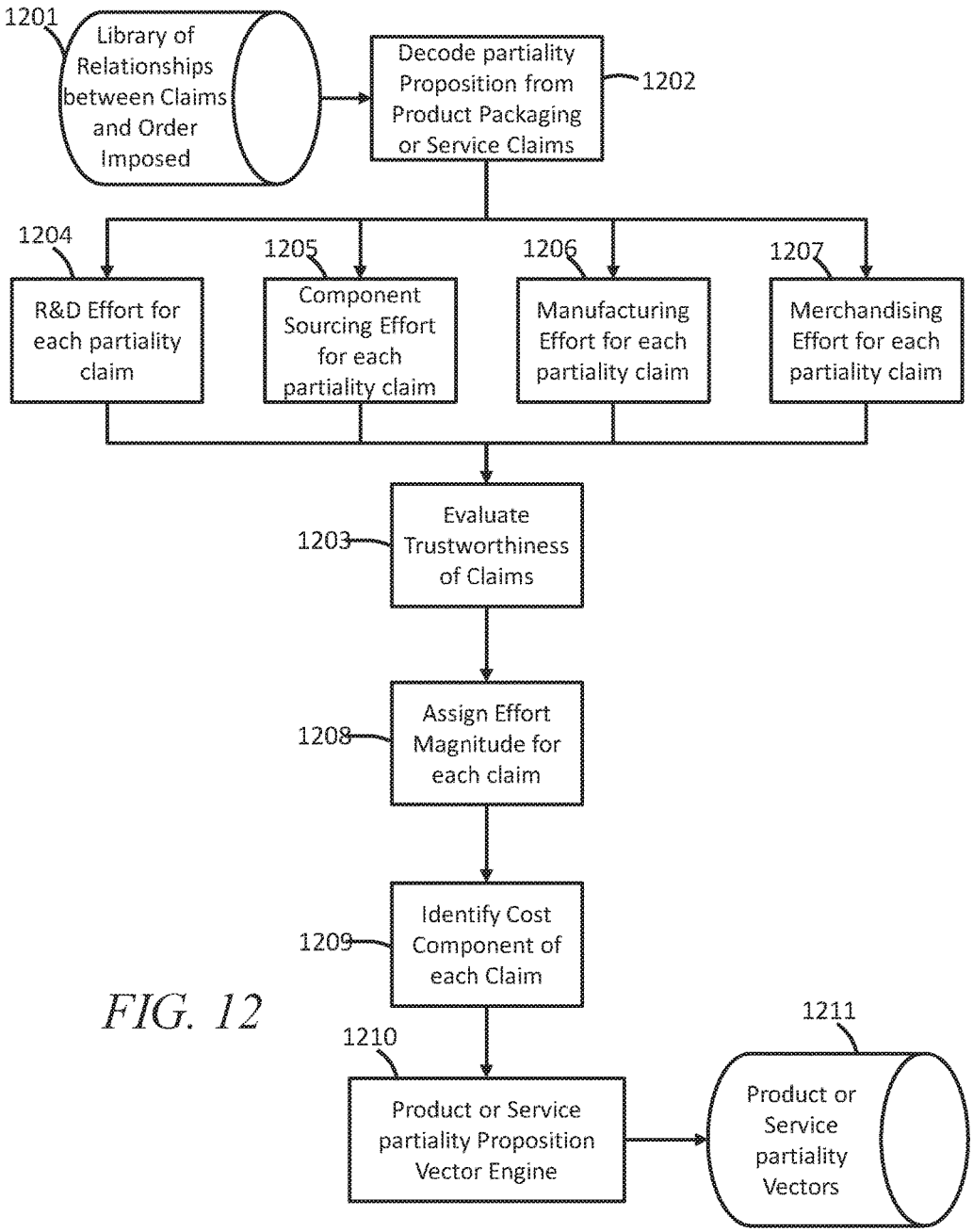
FIG. 12 comprises a flow diagram as configured in accordance with various embodiments of these teachings.

FIG. 12 presents one non-limiting illustrative example in these regards. The illustrated process presumes the availability of a library 1201 of correlated relationships between product/service claims and particular imposed orders. Examples of product/service claims include such things as claims that a particular product results in cleaner laundry or household surfaces, or that a particular product is made in a particular political region (such as a particular state or country), or that a particular product is better for the environment, and so forth. The imposed orders to which such claims are correlated can reflect orders as described above that pertain to corresponding partialities.

At block 1202 this process provides for decoding one or more partiality propositions from specific product packaging (or service claims). For example, the particular textual/graphics-based claims presented on the packaging of a given product can be used to access the aforementioned library 1201 to identify one or more corresponding imposed orders from which one or more corresponding partialities can then be identified.

At block 1203 this process provides for evaluating the trustworthiness of the aforementioned claims. This evaluation can be based upon any one or more of a variety of data points as desired. FIG. 12 illustrates four significant possibilities in these regards. For example, at block 1204 an actual or estimated research and development effort can be quantified for each claim pertaining to a partiality. At block 1205 an actual or estimated component sourcing effort for the product in question can be quantified for each claim pertaining to a partiality. At block 1206 an actual or estimated manufacturing effort for the product in question can be quantified for each claim pertaining to a partiality. And at block 1207 an actual or estimated merchandising effort for the product in question can be quantified for each claim pertaining to a partiality.

If desired, a product claim lacking sufficient trustworthiness may simply be excluded from further consideration. By another approach the product claim can remain in play but a lack of trustworthiness can be reflected, for example, in a corresponding partiality vector direction or magnitude for this particular product.

At block 1208 this process provides for assigning an effort magnitude for each evaluated product/service claim. That effort can constitute a one-dimensional effort (reflecting, for example, only the manufacturing effort) or can constitute a multidimensional effort that reflects, for example, various categories of effort such as the aforementioned research and development effort, component sourcing effort, manufacturing effort, and so forth.

At block 1209 this process provides for identifying a cost component of each claim, this cost component representing a monetary value. At block 1210 this process can use the foregoing information with a product/service partiality propositions vector engine to generate a library 1211 of one or more corresponding partiality vectors for the processed products/services. Such a library can then be used as described herein in conjunction with partiality vector information for various persons to identify, for example, products/services that are well aligned with the partialities of specific individuals.

Figure 13:
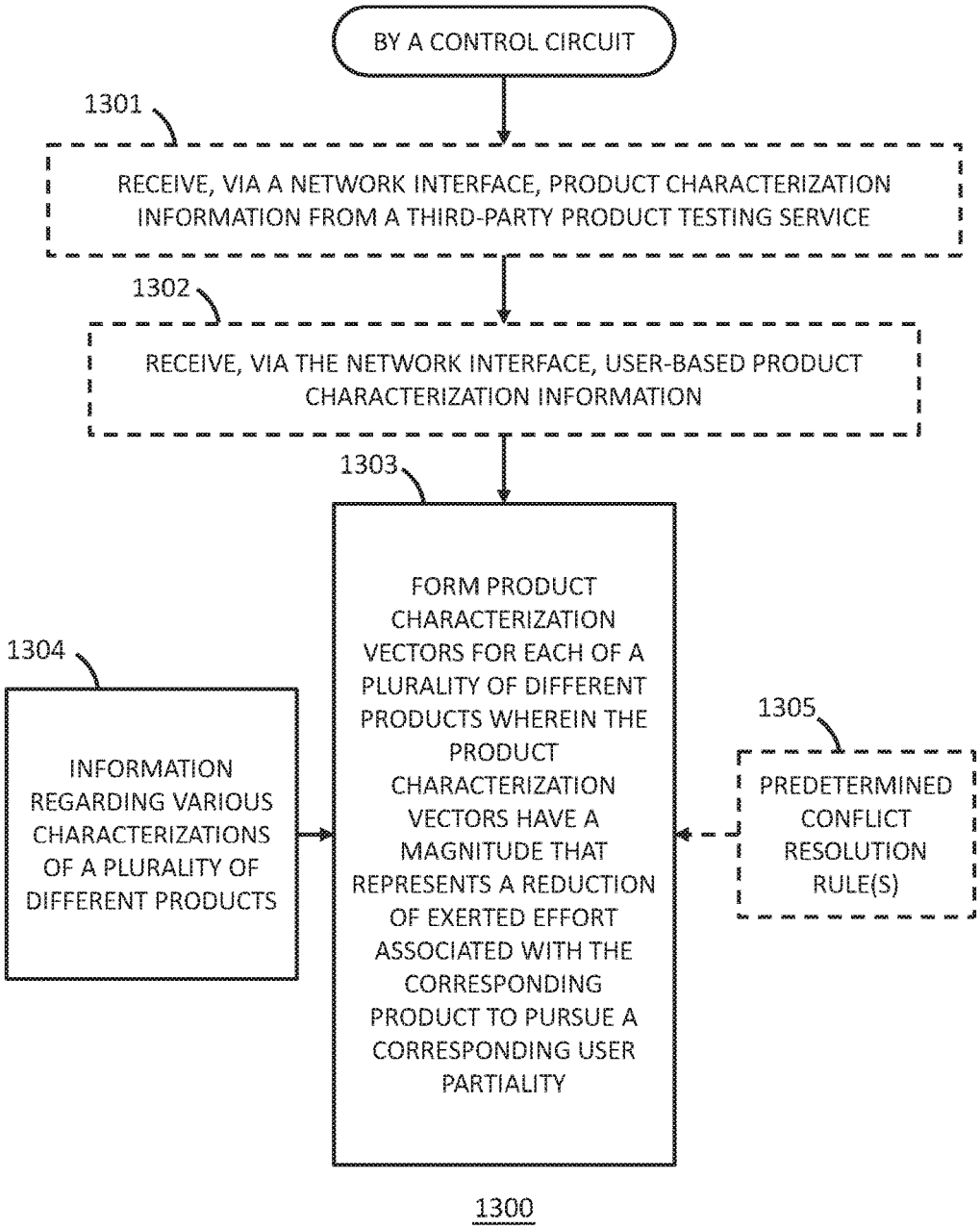
FIG. 13 comprises a flow diagram as configured in accordance with various embodiments of these teachings.

FIG. 13 provides another illustrative example in these same regards and may be employed in lieu of the foregoing or in total or partial combination therewith. Generally speaking, this process 1300 serves to facilitate the formation of product characterization vectors for each of a plurality of different products where the magnitude of the vector length (and/or the vector angle) has a magnitude that represents a reduction of exerted effort associated with the corresponding product to pursue a corresponding user partiality.

By one approach, and as illustrated in FIG. 13, this process 1300 can be carried out by a control circuit of choice. Specific examples of control circuits are provided elsewhere herein.

As described further herein in detail, this process 1300 makes use of information regarding various characterizations of a plurality of different products. These teachings are highly flexible in practice and will accommodate a wide variety of possible information sources and types of information. By one optional approach, and as shown at optional block 1301, the control circuit can receive (for example, via a corresponding network interface of choice) product characterization information from a third-party product testing service. The magazine/web resource Consumers Report provides one useful example in these regards. Such a resource provides objective content based upon testing, evaluation, and comparisons (and sometimes also provides subjective content regarding such things as aesthetics, ease of use, and so forth) and this content, provided as-is or pre-processed as desired, can readily serve as useful third-party product testing service product characterization information.

As another example, any of a variety of product-testing blogs that are published on the Internet can be similarly accessed and the product characterization information available at such resources harvested and received by the control circuit. (The expression "third party" will be understood to refer to an entity other than the entity that operates/controls the control circuit and other than the entity that provides the corresponding product itself.)

As another example, and as illustrated at optional block 1302, the control circuit can receive (again, for example, via a network interface of choice) user-based product characterization information. Examples in these regards include but are not limited to user reviews provided on-line at various retail sites for products offered for sale at such sites. The reviews can comprise metricized content (for example, a rating expressed as a certain number of stars out of a total available number of stars, such as 3 stars out of 5 possible stars) and/or text where the reviewers can enter their objective and subjective information regarding their observations and experiences with the reviewed products. In this case, "user-based" will be understood to refer to users who are not necessarily professional reviewers (though it is possible that content from such persons may be included with the information provided at such a resource) but who presumably purchased the product being reviewed and who have personal experience with that product that forms the basis of their review. By one approach the resource that offers such content may constitute a third party as defined above, but these teachings will also accommodate obtaining such content from a resource operated or sponsored by the enterprise that controls/operates this control circuit.

In any event, this process 1300 provides for accessing (see block 1304) information regarding various characterizations of each of a plurality of different products. This information 1304 can be gleaned as described above and/or can be obtained and/or developed using other resources as desired. As one illustrative example in these regards, the manufacturer and/or distributor of certain products may source useful content in these regards.

These teachings will accommodate a wide variety of information sources and types including both objective characterizing and/or subjective characterizing information for the aforementioned products.

Examples of objective characterizing information include, but are not limited to, ingredients information (i.e., specific components/materials from which the product is made), manufacturing locale information (such as country of origin, state of origin, municipality of origin, region of origin, and so forth), efficacy information (such as metrics regarding the relative effectiveness of the product to achieve a particular end-use result), cost information (such as per product, per ounce, per application or use, and so forth), availability information (such as present in-store availability, on-hand inventory availability at a relevant distribution center, likely or estimated shipping date, and so forth), environmental impact information (regarding, for example, the materials from which the product is made, one or more manufacturing processes by which the product is made, environmental impact associated with use of the product, and so forth), and so forth.

Examples of subjective characterizing information include but are not limited to user sensory perception information (regarding, for example, heaviness or lightness, speed of use, effort associated with use, smell, and so forth), aesthetics information (regarding, for example, how attractive or unattractive the product is in appearance, how well the product matches or accords with a particular design paradigm or theme, and so forth), trustworthiness information (regarding, for example, user perceptions regarding how likely the product is perceived to accomplish a particular purpose or to avoid causing a particular collateral harm), trendiness information, and so forth.

This information 1304 can be curated (or not), filtered, sorted, weighted (in accordance with a relative degree of trust, for example, accorded to a particular source of particular information), and otherwise categorized and utilized as desired. As one simple example in these regards, for some products it may be desirable to only use relatively fresh information (i.e., information not older than some specific cut-off date) while for other products it may be acceptable (or even desirable) to use, in lieu of fresh information or in combination therewith, relatively older information. As another simple example, it may be useful to use only information from one particular geographic region to characterize a particular product and to therefore not use information from other geographic regions.

At block 1303 the control circuit uses the foregoing information 1304 to form product characterization vectors for each of the plurality of different products. By one approach these product characterization vectors have a magnitude (for the length of the vector and/or the angle of the vector) that represents a reduction of exerted effort associated with the corresponding product to pursue a corresponding user partiality (as is otherwise discussed herein).

It is possible that a conflict will become evident as between various ones of the aforementioned items of information 1304. In particular, the available characterizations for a given product may not all be the same or otherwise in accord with one another. In some cases it may be appropriate to literally or effectively calculate and use an average to accommodate such a conflict. In other cases it may be useful to use one or more other predetermined conflict resolution rules 1305 to automatically resolve such conflicts when forming the aforementioned product characterization vectors.

These teachings will accommodate any of a variety of rules in these regards. By one approach, for example, the rule can be based upon the age of the information (where, for example the older (or newer, if desired) data is preferred or weighted more heavily than the newer (or older, if desired) data. By another approach, the rule can be based upon a number of user reviews upon which the user-based product characterization information is based (where, for example, the rule specifies that whichever user-based product characterization information is based upon a larger number of user reviews will prevail in the event of a conflict). By another approach, the rule can be based upon information regarding historical accuracy of information from a particular information source (where, for example, the rule specifies that information from a source with a better historical record of accuracy shall prevail over information from a source with a poorer historical record of accuracy in the event of a conflict).

By yet another approach, the rule can be based upon social media. For example, social media-posted reviews may be used as a tie-breaker in the event of a conflict between other more-favored sources. By another approach, the rule can be based upon a trending analysis. And by yet another approach the rule can be based upon the relative strength of brand awareness for the product at issue (where, for example, the rule specifies resolving a conflict in favor of a more favorable characterization when dealing with a product from a strong brand that evidences considerable consumer goodwill and trust).

It will be understood that the foregoing examples are intended to serve an illustrative purpose and are not offered as an exhaustive listing in these regards. It will also be understood that any two or more of the foregoing rules can be used in combination with one another to resolve the aforementioned conflicts.

By one approach the aforementioned product characterization vectors are formed to serve as a universal characterization of a given product. By another approach, however, the aforementioned information 1304 can be used to form product characterization vectors for a same characterization factor for a same product to thereby correspond to different usage circumstances of that same product. Those different usage circumstances might comprise, for example, different geographic regions of usage, different levels of user expertise (where, for example, a skilled, professional user might have different needs and expectations for the product than a casual, lay user), different levels of expected use, and so forth. In particular, the different vectorized results for a same characterization factor for a same product may have differing magnitudes from one another to correspond to different amounts of reduction of the exerted effort associated with that product under the different usage circumstances.

Figure 14:
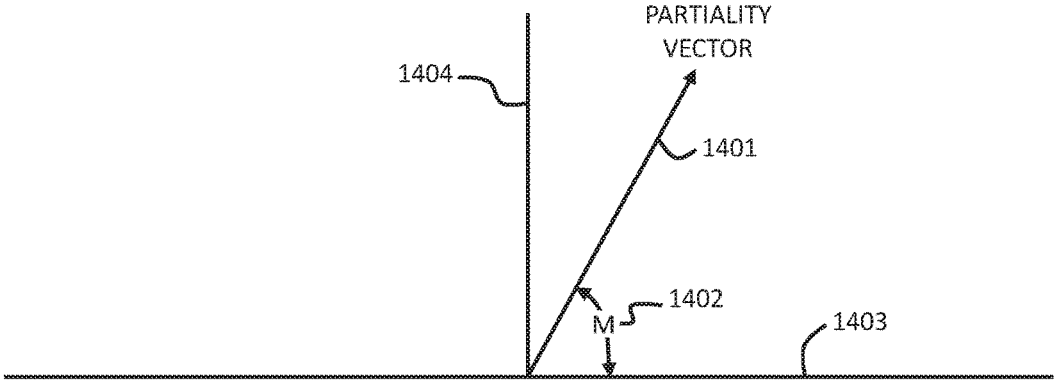
FIG. 14 comprises a graphic representation as configured in accordance with various embodiments of these teachings.

As noted above, the magnitude corresponding to a particular partiality vector for a particular person can be expressed by the angle of that partiality vector. FIG. 14 provides an illustrative example in these regards. In this example the partiality vector 1401 has an angle M 1402 (and where the range of available positive magnitudes range from a minimal magnitude represented by 0° (as denoted by reference numeral 1403) to a maximum magnitude represented by 90° (as denoted by reference numeral 1404)). Accordingly, the person to whom this partiality vector 1401 pertains has a relatively strong (but not absolute) belief in an amount of good that comes from an order associated with that partiality.

Figure 15:
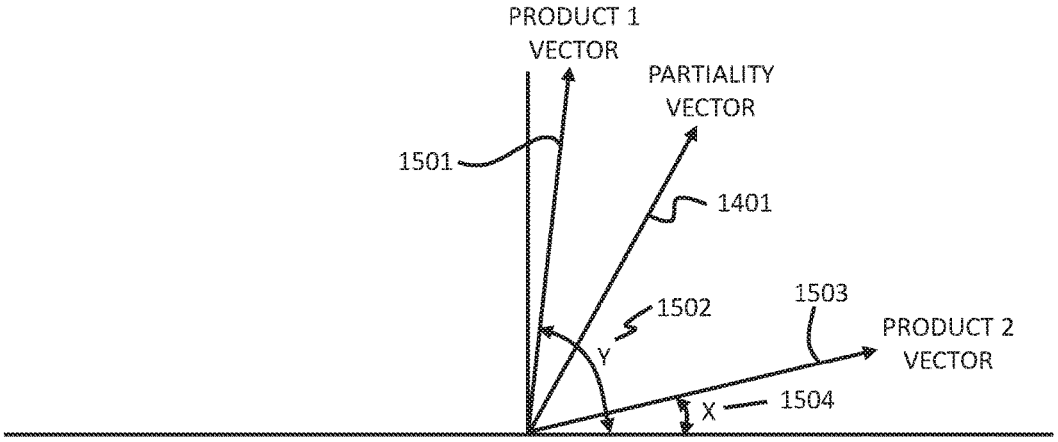
FIG. 15 comprises a graphic representation as configured in accordance with various embodiments of these teachings.

FIG. 15, in turn, presents that partiality vector 1501 in context with the product characterization vectors 1501 and 1503 for a first product and a second product, respectively. In this example the product characterization vector 1501 for the first product has an angle Y 1502 that is greater than the angle M 1402 for the aforementioned partiality vector 1401 by a relatively small amount while the product characterization vector 1503 for the second product has an angle X 1504 that is considerably smaller than the angle M 1402 for the partiality vector 1401.

Since, in this example, the angles of the various vectors represent the magnitude of the person's specified partiality or the extent to which the product aligns with that partiality, respectively, vector dot product calculations can serve to help identify which product best aligns with this partiality. Such an approach can be particularly useful when the lengths of the vectors are allowed to vary as a function of one or more parameters of interest. As those skilled in the art will understand, a vector dot product is an algebraic operation that takes two equal-length sequences of numbers (in this case, coordinate vectors) and returns a single number.

This operation can be defined either algebraically or geometrically. Algebraically, it is the sum of the products of the corresponding entries of the two sequences of numbers. Geometrically, it is the product of the Euclidean magnitudes of the two vectors and the cosine of the angle between them. The result is a scalar rather than a vector. As regards the present illustrative example, the resultant scaler value for the vector dot product of the product 1 vector 1501 with the partiality vector 1401 will be larger than the resultant scaler value for the vector dot product of the product 2 vector 1503 with the partiality vector 1401. Accordingly, when using vector angles to impart this magnitude information, the vector dot product operation provides a simple and convenient way to determine proximity between a particular partiality and the performance/properties of a particular product to thereby greatly facilitate identifying a best product amongst a plurality of candidate products.

By way of further illustration, consider an example where a particular consumer has a strong partiality for organic produce and is financially able to afford to pay to observe that partiality. A dot product result for that person with respect to a product characterization vector(s) for organic apples that represent a cost of $10 on a weekly basis (i.e., Cv·P1v) might equal (1,1), hence yielding a scalar result of ||1|| (where Cv refers to the corresponding partiality vector for this person and P1v represents the corresponding product characterization vector for these organic apples). Conversely, a dot product result for this same person with respect to a product characterization vector(s) for non-organic apples that represent a cost of $5 on a weekly basis (i.e., Cv·P2v) might instead equal (1,0), hence yielding a scalar result of ||½||. Accordingly, although the organic apples cost more than the non-organic apples, the dot product result for the organic apples exceeds the dot product result for the non-organic apples and therefore identifies the more expensive organic apples as being the best choice for this person.

To continue with the foregoing example, consider now what happens when this person subsequently experiences some financial misfortune (for example, they lose their job and have not yet found substitute employment). Such an event can present the "force" necessary to alter the previously-established "inertia" of this person's steady-state partialities; in particular, these negatively-changed financial circumstances (in this example) alter this person's budget sensitivities (though not, of course their partiality for organic produce as compared to non-organic produce). The scalar result of the dot product for the $5/week non-organic apples may remain the same (i.e., in this example, ||½||), but the dot product for the $10/week organic apples may now drop (for example, to ||½|| as well). Dropping the quantity of organic apples purchased, however, to reflect the tightened financial circumstances for this person may yield a better dot product result. For example, purchasing only $5 (per week) of organic apples may produce a dot product result of ||1||. The best result for this person, then, under these circumstances, is a lesser quantity of organic apples rather than a larger quantity of non-organic apples.

In a typical application setting, it is possible that this person's loss of employment is not, in fact, known to the system. Instead, however, this person's change of behavior (i.e., reducing the quantity of the organic apples that are purchased each week) might well be tracked and processed to adjust one or more partialities (either through an addition or deletion of one or more partialities and/or by adjusting the corresponding partiality magnitude) to thereby yield this new result as a preferred result.

The foregoing simple examples clearly illustrate that vector dot product approaches can be a simple yet powerful way to quickly eliminate some product options while simultaneously quickly highlighting one or more product options as being especially suitable for a given person.

Such vector dot product calculations and results, in turn, help illustrate another point as well. As noted above, sine waves can serve as a potentially useful way to characterize and view partiality information for both people and products/services. In those regards, it is worth noting that a vector dot product result can be a positive, zero, or even negative value. That, in turn, suggests representing a particular solution as a normalization of the dot product value relative to the maximum possible value of the dot product. Approached this way, the maximum amplitude of a particular sine wave will typically represent a best solution.

Taking this approach further, by one approach the frequency (or, if desired, phase) of the sine wave solution can provide an indication of the sensitivity of the person to product choices (for example, a higher frequency can indicate a relatively highly reactive sensitivity while a lower frequency can indicate the opposite). A highly sensitive person is likely to be less receptive to solutions that are less than fully optimum and hence can help to narrow the field of candidate products while, conversely, a less sensitive person is likely to be more receptive to solutions that are less than fully optimum and can help to expand the field of candidate products.

Figure 16:
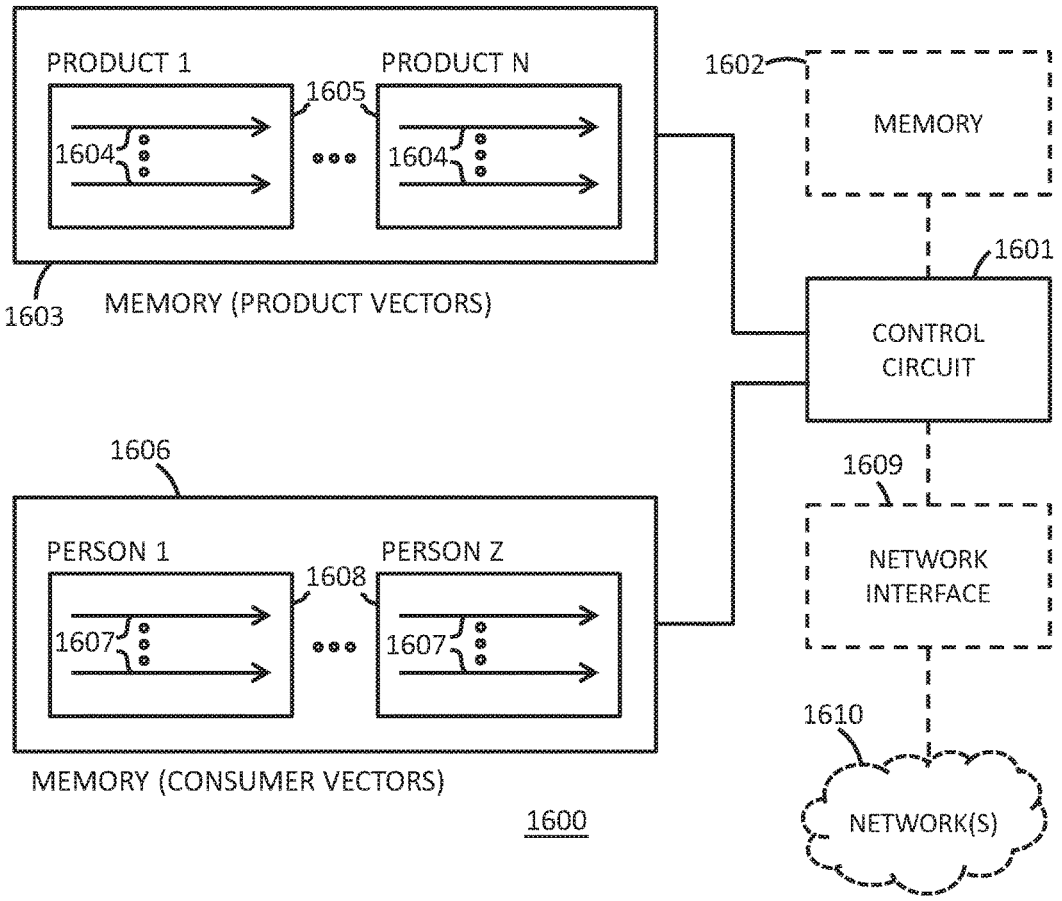
FIG. 16 comprises a block diagram as configured in accordance with various embodiments of these teachings.

FIG. 16 presents an illustrative apparatus 1600 for conducting, containing, and utilizing the foregoing content and capabilities. In this particular example, the enabling apparatus 1600 includes a control circuit 1601. Being a "circuit," the control circuit 1601 therefore comprises structure that includes at least one (and typically many) electrically-conductive paths (such as paths comprised of a conductive metal such as copper or silver) that convey electricity in an ordered manner, which path(s) will also typically include corresponding electrical components (both passive (such as resistors and capacitors) and active (such as any of a variety of semiconductor-based devices) as appropriate) to permit the circuit to effect the control aspect of these teachings.

Such a control circuit 1601 can comprise a fixed-purpose hard-wired hardware platform (including but not limited to an application-specific integrated circuit (ASIC) (which is an integrated circuit that is customized by design for a particular use, rather than intended for general-purpose use), a field-programmable gate array (FPGA), and the like) or can comprise a partially or wholly-programmable hardware platform (including but not limited to microcontrollers, microprocessors, and the like). These architectural options for such structures are well known and understood in the art and require no further description here. This control circuit 1601 is configured (for example, by using corresponding programming as will be well understood by those skilled in the art) to carry out one or more of the steps, actions, and/or functions described herein.

By one optional approach the control circuit 1601 operably couples to a memory 1602. This memory 1602 may be integral to the control circuit 1601 or can be physically discrete (in whole or in part) from the control circuit 1601 as desired. This memory 1602 can also be local with respect to the control circuit 1601 (where, for example, both share a common circuit board, chassis, power supply, and/or housing) or can be partially or wholly remote with respect to the control circuit 1601 (where, for example, the memory 1602 is physically located in another facility, metropolitan area, or even country as compared to the control circuit 1601).

This memory 1602 can serve, for example, to non-transitorily store the computer instructions that, when executed by the control circuit 1601, cause the control circuit 1601 to behave as described herein. (As used herein, this reference to "non-transitorily" will be understood to refer to a non-ephemeral state for the stored contents (and hence excludes when the stored contents merely constitute signals or waves) rather than volatility of the storage media itself and hence includes both non-volatile memory (such as read-only memory (ROM) as well as volatile memory (such as an erasable programmable read-only memory (EPROM).)

Either stored in this memory 1602 or, as illustrated, in a separate memory 1603 are the vectorized characterizations 1604 for each of a plurality of products 1605 (represented here by a first product through an Nth product where "N" is an integer greater than "1"). In addition, and again either stored in this memory 1602 or, as illustrated, in a separate memory 1606 are the vectorized characterizations 1607 for each of a plurality of individual persons 1608 (represented here by a first person through a Zth person wherein "Z" is also an integer greater than "1").

In this example the control circuit 1601 also operably couples to a network interface 1609. So configured the control circuit 1601 can communicate with other elements (both within the apparatus 1600 and external thereto) via the network interface 1609. Network interfaces, including both wireless and non-wireless platforms, are well understood in the art and require no particular elaboration here. This network interface 1609 can compatibly communicate via whatever network or networks 1610 may be appropriate to suit the particular needs of a given application setting. Both communication networks and network interfaces are well understood areas of prior art endeavor and therefore no further elaboration will be provided here in those regards for the sake of brevity.

Figure 17:
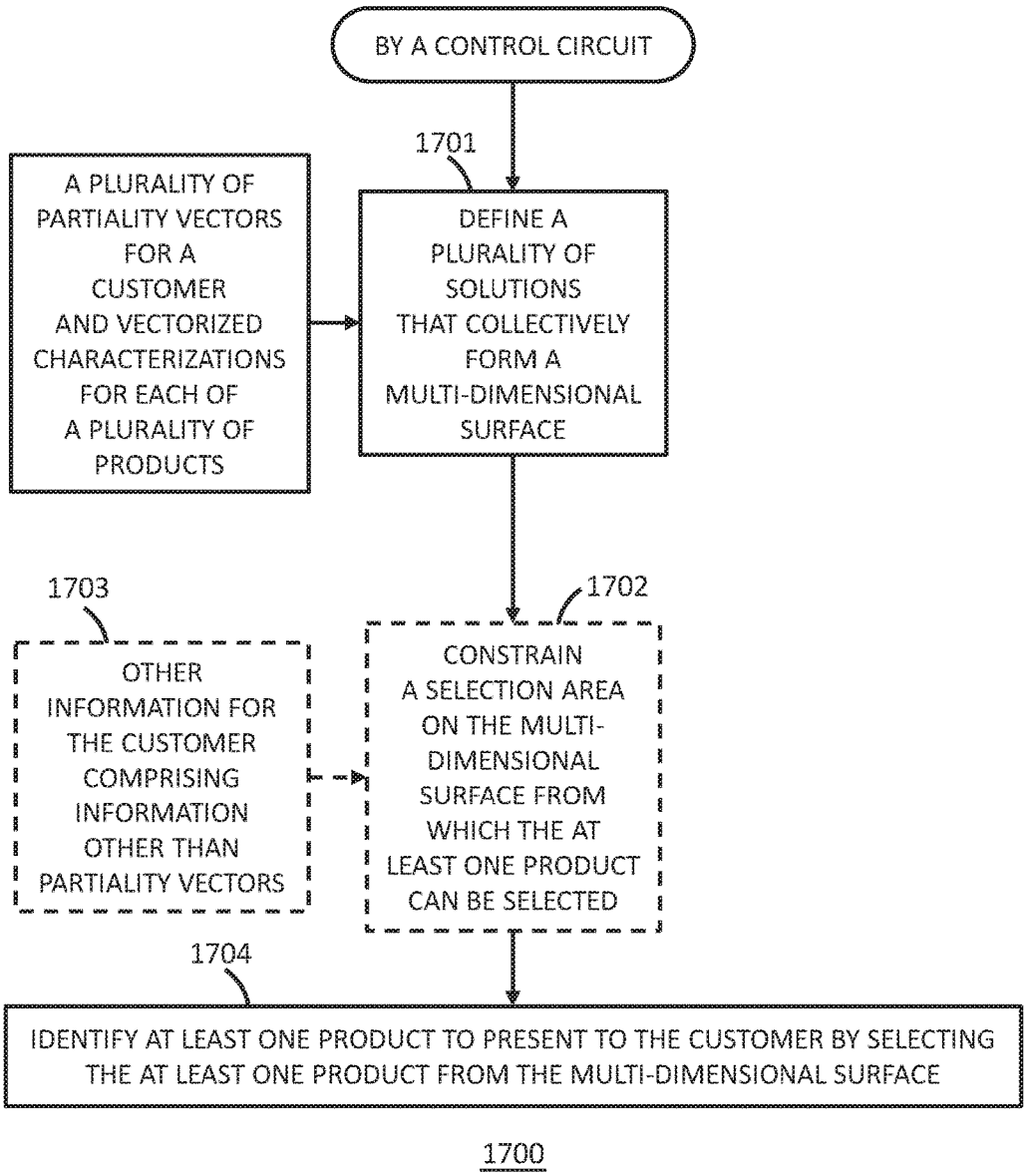
FIG. 17 comprises a flow diagram as configured in accordance with various embodiments of these teachings.
Figure 18:
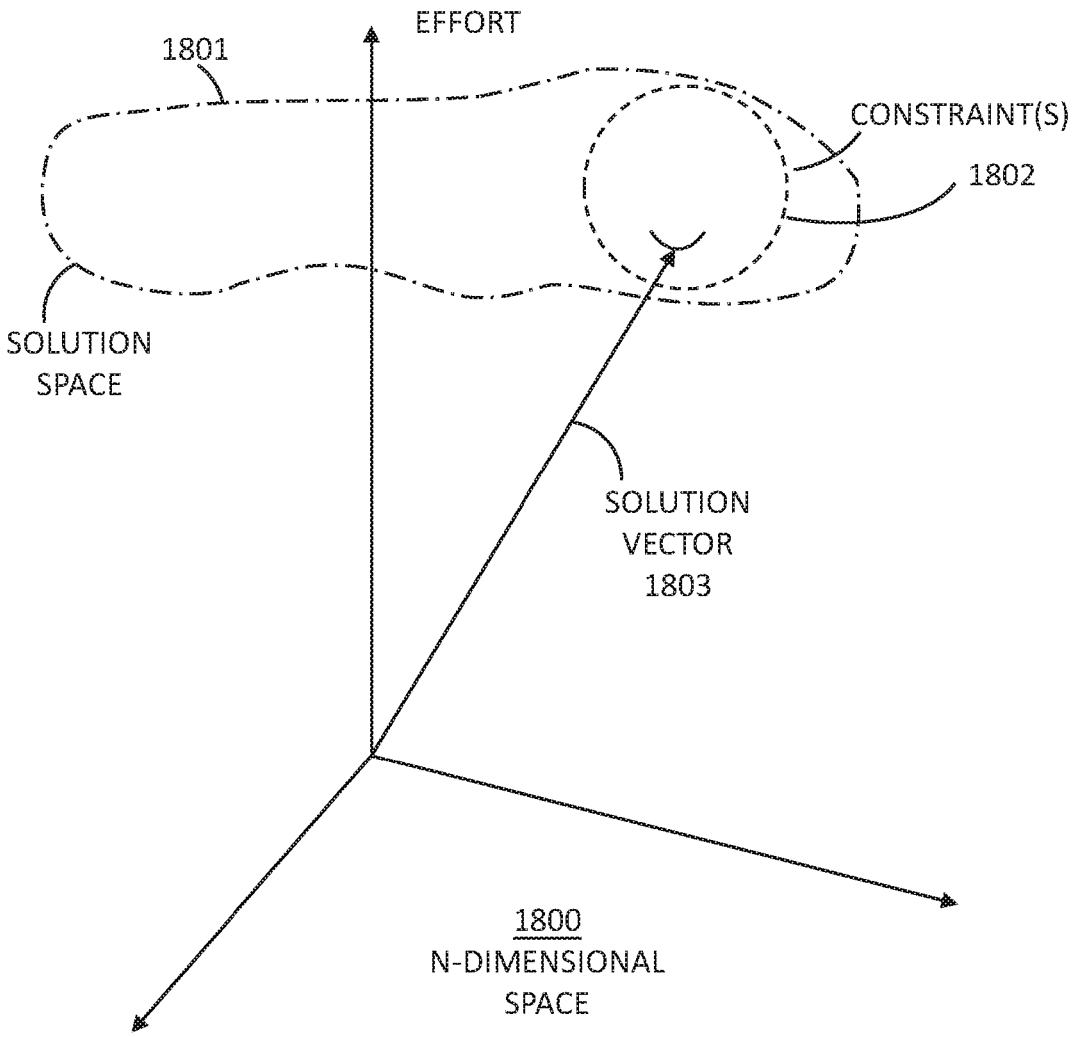
FIG. 18 comprises a graph as configured in accordance with various embodiments of these teachings.
Figure 19:
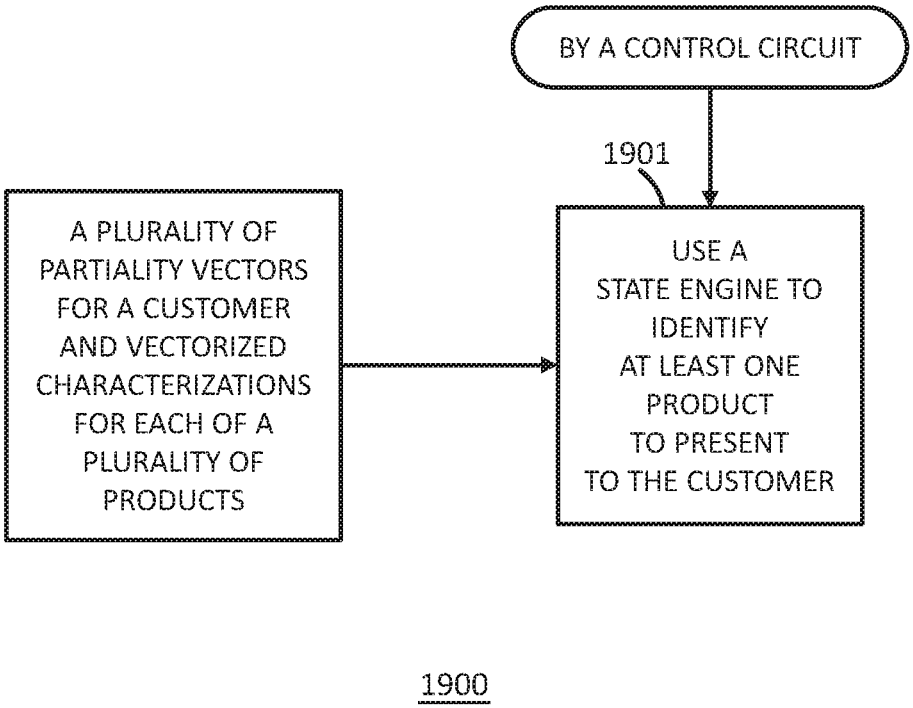
FIG. 19 comprises a flow diagram as configured in accordance with various embodiments of these teachings.

By one approach, and referring now to FIG. 17, the control circuit 1601 is configured to use the aforementioned partiality vectors 1607 and the vectorized product characterizations 1604 to define a plurality of solutions that collectively form a multidimensional surface (per block 1701). FIG. 18 provides an illustrative example in these regards. FIG. 18 represents an N-dimensional space 1800 and where the aforementioned information for a particular customer yielded a multi-dimensional surface denoted by reference numeral 1801. (The relevant value space is an N-dimensional space where the belief in the value of a particular ordering of one's life only acts on value propositions in that space as a function of a least-effort functional relationship.)

Generally speaking, this surface 1801 represents all possible solutions based upon the foregoing information. Accordingly, in a typical application setting this surface 1801 will contain/represent a plurality of discrete solutions. That said, and also in a typical application setting, not all of those solutions will be similarly preferable. Instead, one or more of those solutions may be particularly useful/appropriate at a given time, in a given place, for a given customer.

With continued reference to FIGS. 17 and 18, at optional block 1702 the control circuit 1601 can be configured to use information for the customer 1703 (other than the aforementioned partiality vectors 1607) to constrain a selection area 1802 on the multi-dimensional surface 1801 from which at least one product can be selected for this particular customer. By one approach, for example, the constraints can be selected such that the resultant selection area 1802 represents the best 95th percentile of the solution space. Other target sizes for the selection area 1802 are of course possible and may be useful in a given application setting.

The aforementioned other information 1703 can comprise any of a variety of information types. By one approach, for example, this other information comprises objective information. (As used herein, "objective information" will be understood to constitute information that is not influenced by personal feelings or opinions and hence constitutes unbiased, neutral facts.)

One particularly useful category of objective information comprises objective information regarding the customer. Examples in these regards include, but are not limited to, location information regarding a past, present, or planned/scheduled future location of the customer, budget information for the customer or regarding which the customer must strive to adhere (such that, by way of example, a particular product/solution area may align extremely well with the customer's partialities but is well beyond that which the customer can afford and hence can be reasonably excluded from the selection area 1802), age information for the customer, and gender information for the customer. Another example in these regards is information comprising objective logistical information regarding providing particular products to the customer. Examples in these regards include but are not limited to current or predicted product availability, shipping limitations (such as restrictions or other conditions that pertain to shipping a particular product to this particular customer at a particular location), and other applicable legal limitations (pertaining, for example, to the legality of a customer possessing or using a particular product at a particular location).

At block 1704 the control circuit 1601 can then identify at least one product to present to the customer by selecting that product from the multi-dimensional surface 1801. In the example of FIG. 18, where constraints have been used to define a reduced selection area 1802, the control circuit 1601 is constrained to select that product from within that selection area 1802. For example, and in accordance with the description provided herein, the control circuit 1601 can select that product via solution vector 1803 by identifying a particular product that requires a minimal expenditure of customer effort while also remaining compliant with one or more of the applied objective constraints based, for example, upon objective information regarding the customer and/or objective logistical information regarding providing particular products to the customer.

So configured, and as a simple example, the control circuit 1601 may respond per these teachings to learning that the customer is planning a party that will include seven other invited individuals. The control circuit 1601 may therefore be looking to identify one or more particular beverages to present to the customer for consideration in those regards. The aforementioned partiality vectors 1607 and vectorized product characterizations 1604 can serve to define a corresponding multi-dimensional surface 1801 that identifies various beverages that might be suitable to consider in these regards.

Objective information regarding the customer and/or the other invited persons, however, might indicate that all or most of the participants are not of legal drinking age. In that case, that objective information may be utilized to constrain the available selection area 1802 to beverages that contain no alcohol. As another example in these regards, the control circuit 1601 may have objective information that the party is to be held in a state park that prohibits alcohol and may therefore similarly constrain the available selection area 1802 to beverages that contain no alcohol.

As described above, the aforementioned control circuit 1601 can utilize information including a plurality of partiality vectors for a particular customer along with vectorized product characterizations for each of a plurality of products to identify at least one product to present to a customer. By one approach 1900, and referring to FIG. 19, the control circuit 1601 can be configured as (or to use) a state engine to identify such a product (as indicated at block 1901). As used herein, the expression "state engine" will be understood to refer to a finite-state machine, also sometimes known as a finite-state automaton or simply as a state machine.

Generally speaking, a state engine is a basic approach to designing both computer programs and sequential logic circuits. A state engine has only a finite number of states and can only be in one state at a time. A state engine can change from one state to another when initiated by a triggering event or condition often referred to as a transition. Accordingly, a particular state engine is defined by a list of its states, its initial state, and the triggering condition for each transition.

Figure 20:
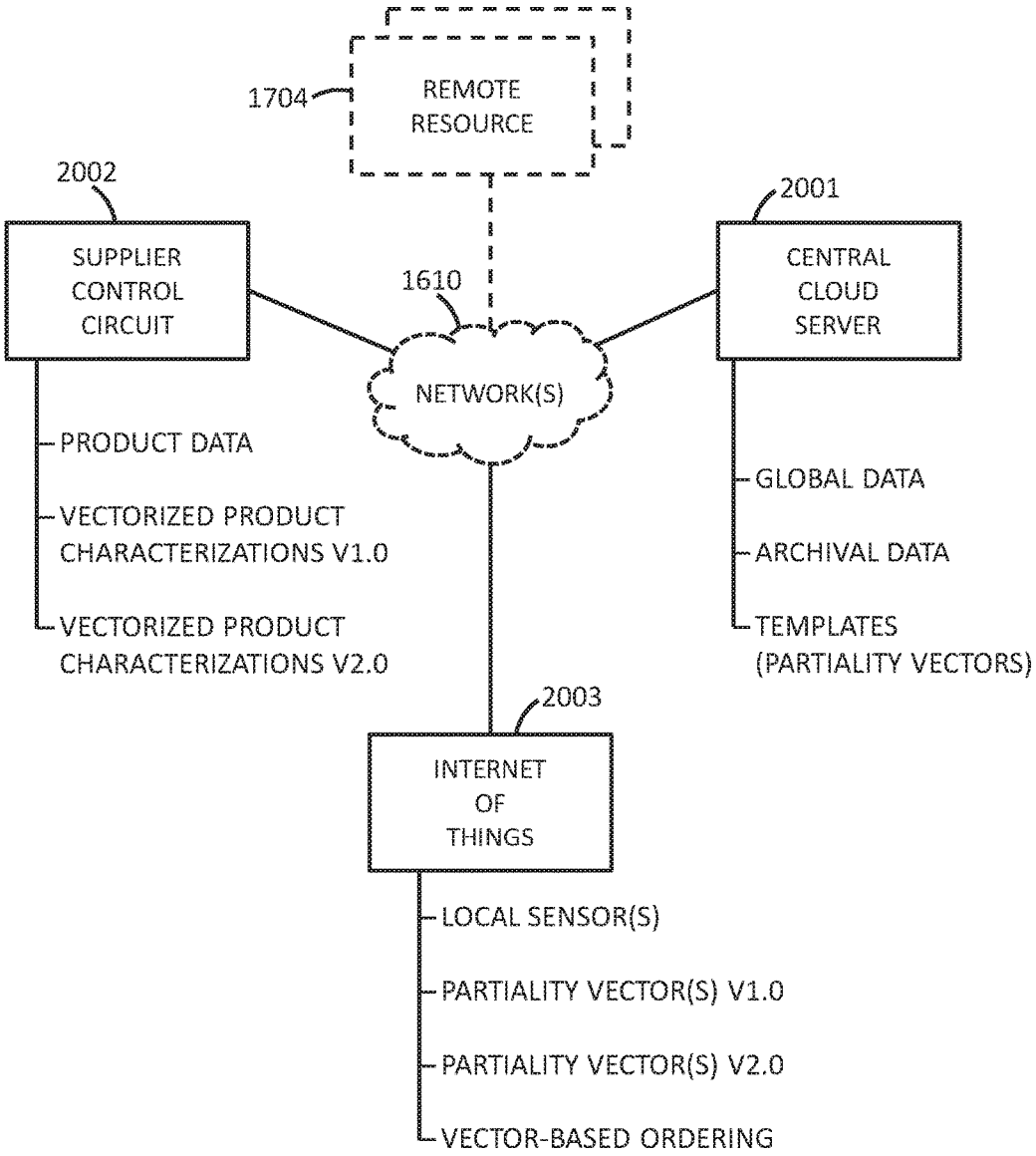
FIG. 20 comprises a block diagram as configured in accordance with various embodiments of these teachings.

It will be appreciated that the apparatus 1600 described above can be viewed as a literal physical architecture or, if desired, as a logical construct. For example, these teachings can be enabled and operated in a highly centralized manner (as might be suggested when viewing that apparatus 1600 as a physical construct) or, conversely, can be enabled and operated in a highly decentralized manner. FIG. 20 provides an example as regards the latter.

In this illustrative example a central cloud server 2001, a supplier control circuit 2002, and the aforementioned Internet of Things 2003 communicate via the aforementioned network 1610.

The central cloud server 2001 can receive, store, and/or provide various kinds of global data (including, for example, general demographic information regarding people and places, profile information for individuals, product descriptions and reviews, and so forth), various kinds of archival data (including, for example, historical information regarding the aforementioned demographic and profile information and/or product descriptions and reviews), and partiality vector templates as described herein that can serve as starting point general characterizations for particular individuals as regards their partialities. Such information may constitute a public resource and/or a privately-curated and accessed resource as desired. (It will also be understood that there may be more than one such central cloud server 2001 that store identical, overlapping, or wholly distinct content.)

The supplier control circuit 2002 can comprise a resource that is owned and/or operated on behalf of the suppliers of one or more products (including but not limited to manufacturers, wholesalers, retailers, and even resellers of previously-owned products). This resource can receive, process and/or analyze, store, and/or provide various kinds of information. Examples include but are not limited to product data such as marketing and packaging content (including textual materials, still images, and audio-video content), operators and installers manuals, recall information, professional and non-professional reviews, and so forth.

Another example comprises vectorized product characterizations as described herein. More particularly, the stored and/or available information can include both prior vectorized product characterizations (denoted in FIG. 20 by the expression "vectorized product characterizations V1.0") for a given product as well as subsequent, updated vectorized product characterizations (denoted in FIG. 20 by the expression "vectorized product characterizations V2.0") for the same product. Such modifications may have been made by the supplier control circuit 2002 itself or may have been made in conjunction with or wholly by an external resource as desired.

The Internet of Things 2003 can comprise any of a variety of devices and components that may include local sensors that can provide information regarding a corresponding user's circumstances, behaviors, and reactions back to, for example, the aforementioned central cloud server 2001 and the supplier control circuit 2002 to facilitate the development of corresponding partiality vectors for that corresponding user. As previously discussed, these sensors can be used to monitor a person and/or the person's environment (e.g., his or her home, workplace, etc.). These sensors can include motion sensors, image sensors, noise sensors, light sensors, weight sensors, usage sensors, door sensors, or any other suitable type of sensor. Additionally, these sensors can be worn, or otherwise hosted, by the person (e.g., a fitness band, heartrate monitor, etc.). Again, however, these teachings will also support a decentralized approach. In many cases devices that are fairly considered to be members of the Internet of Things 2003 constitute network edge elements (i.e., network elements deployed at the edge of a network). In some case the network edge element is configured to be personally carried by the person when operating in a deployed state. Examples include but are not limited to so-called smart phones, smart watches, fitness monitors that are worn on the body, and so forth. In other cases, the network edge element may be configured to not be personally carried by the person when operating in a deployed state. This can occur when, for example, the network edge element is too large and/or too heavy to be reasonably carried by an ordinary average person. This can also occur when, for example, the network edge element has operating requirements ill-suited to the mobile environment that typifies the average person.

For example, a so-called smart phone can itself include a suite of partiality vectors for a corresponding user (i.e., a person that is associated with the smart phone which itself serves as a network edge element) and employ those partiality vectors to facilitate vector-based ordering (either automated or to supplement the ordering being undertaken by the user) as is otherwise described herein. In that case, the smart phone can obtain corresponding vectorized product characterizations from a remote resource such as, for example, the aforementioned supplier control circuit 2002 and use that information in conjunction with local partiality vector information to facilitate the vector-based ordering.

Also, if desired, the smart phone in this example can itself modify and update partiality vectors for the corresponding user. To illustrate this idea in FIG. 20, this device can utilize, for example, information gained at least in part from local sensors to update a locally-stored partiality vector (represented in FIG. 20 by the expression "partiality vector V1.0") to obtain an updated locally-stored partiality vector (represented in FIG. 20 by the expression "partiality vector V2.0"). Using this approach, a user's partiality vectors can be locally stored and utilized. Such an approach may better comport with a particular user's privacy concerns.

Figure 21:
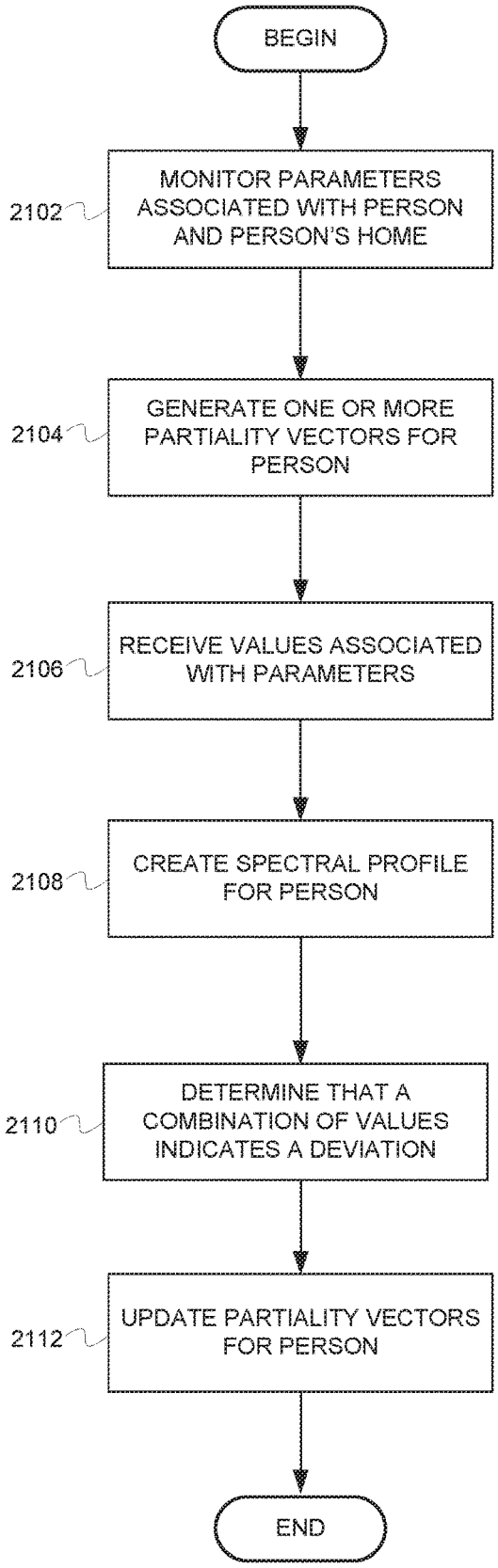
FIG. 21 is a flow chart depicting example operations for monitoring parameters associated with a person and the person's home and updating a partiality vector for the person based on a deviation.

FIG. 21 is a flow chart depicting example operations for monitoring parameters associated with a person and the person's home and updating a partiality vector for the person based on a deviation. The flow begins at block 2102.

At block 2102, parameters associated with a person and a person's home are monitored. For example, a plurality of sensors can monitor the person and/or his or her home. The plurality of sensors can be located about the person's home and/or on the person. The plurality of sensors can include sensors that monitor the person and his or her activity around his or her home. For example, the plurality of sensors can include biometric sensors, motion sensors, noise sensors, light sensors, weight sensors, and any other suitable type of sensor. The flow continues at block 2104.

At block 2104, one or more partiality vectors for the person are generated. For example, a control circuit can generate the one or more partiality vectors. The partiality vectors are representative of partiality information for the person. In some embodiments, the partiality information for the person can be based, at least in part, on information gleaned from the plurality of sensors. Additionally, or alternatively, the partiality information can be based on information derived from other sources, such as historical purchases or actions of the person, the person's online presence, previous partialities indicated by the person, etc. The partiality vectors have at least one of a magnitude and an angle. The magnitude and/or the angle of the partiality vector corresponds to a magnitude of the person's belief in an amount of good that comes from an order associated with that partiality. The flow continues at block 2106.

At block 2106, values associated with the parameters are received. For example, the control circuit can receive the values associated with the parameters from the plurality of sensors. The values associated with the parameters can be numeric, state, and/or qualitative values collected by the plurality of sensors. For example, the values associated with the parameters can be weights, times, indications of movement, indications of a state of a device (e.g., on or off), quality of service, etc. The flow continues at block 2108.

At block 2108, a spectral profile for the person is created. For example, the control circuit can create the spectral profile for the person. The spectral profile is based, at least in part, on the values associated with the parameters. Put simply, the spectral profile is a representation of the person's activities and, in essence, provides a personality of the person that reflects not only how but why the person responses to a variety of life experiences. In some embodiments, the spectral profile can represent changes to the person's behavior over a given period of time. The spectral profile can be multidimensional, if need be, based on the requirements of the values making up the spectral profile. Based on the values associated with the parameters, the spectral profile can have one or more frequencies. Additionally, one or more of these frequencies may be primary frequencies while others of the frequencies may be secondary frequencies. The flow continues at block 2110.

At block 2110, it is determined that a combination of the values associated with the parameters indicates a deviation. For example, the control circuit can determine, based on values associated with the parameters, the spectral profile for the person, and a routine experiential base state for the person that a deviation has occurred. The deviation can be an aberration from the person's normal routine or known partialities, as compared to the person's spectral profile and/or routine experiential base state. For example, the deviation could be that the person is no longer going to the gym, eating healthy food, partial to products that are environmentally friendly, partial to products that are inexpensive, etc. The flow continues at block 2112.

At block 2112, at least one of the partiality vectors for the person is updated. For example, the control circuit can update at least one partiality vectors for the person. In some embodiments, the partiality vector is updated based on the deviation. For example, if the deviation is that the person no longer partial to products that are environmentally friendly, the control circuit can update a partiality vector for the person reflecting a decreased magnitude and/or angle of a partiality vector associated with a preference for products that are environmentally friendly. That is, the partiality vector can be updated to reflect the person's diminished belief in the amount of good that comes from the use of environmentally friendly products. As another example, if the deviation is that the person is going to the gym less frequently, the control circuit can update the magnitude and/or angle of the partiality vector indicating a diminished belief in the amount of good that comes from physical activity.

It will be understood that the smart phone employed in the immediate example is intended to serve in an illustrative capacity and is not intended to suggest any particular limitations in these regards. In fact, any of a wide variety of Internet of Things devices/components could be readily configured in the same regards. As one simple example in these regards, a computationally-capable networked refrigerator could be configured to order appropriate perishable items for a corresponding user as a function of that user's partialities.

Presuming a decentralized approach, these teachings will accommodate any of a variety of other remote resources 2004. These remote resources 2004 can, in turn, provide static or dynamic information and/or interaction opportunities or analytical capabilities that can be called upon by any of the above-described network elements. Examples include but are not limited to voice recognition, pattern and image recognition, facial recognition, statistical analysis, computational resources, encryption and decryption services, fraud and misrepresentation detection and prevention services, digital currency support, and so forth.

As already suggested above, these approaches provide powerful ways for identifying products and/or services that a given person, or a given group of persons, may likely wish to buy to the exclusion of other options. When the magnitude and direction of the relevant/required meta-force vector that comes from the perceived effort to impose order is known, these teachings will facilitate, for example, engineering a product or service containing potential energy in the precise ordering direction to provide a total reduction of effort. Since people generally take the path of least effort (consistent with their partialities) they will typically accept such a solution.

As one simple illustrative example, a person who exhibits a partiality for food products that emphasize health, natural ingredients, and a concern to minimize sugars and fats may be presumed to have a similar partiality for pet foods because such partialities may be based on a value system that extends beyond themselves to other living creatures within their sphere of concern. If other data is available to indicate that this person in fact has, for example, two pet dogs, these partialities can be used to identify dog food products having well-aligned vectors in these same regards. This person could then be solicited to purchase such dog food products using any of a variety of solicitation approaches (including but not limited to general informational advertisements, discount coupons or rebate offers, sales calls, free samples, and so forth).

As another simple example, the approaches described herein can be used to filter out products/services that are not likely to accord well with a given person's partiality vectors. In particular, rather than emphasizing one particular product over another, a given person can be presented with a group of products that are available to purchase where all of the vectors for the presented products align to at least some predetermined degree of alignment/accord and where products that do not meet this criterion are simply not presented.

And as yet another simple example, a particular person may have a strong partiality towards both cleanliness and orderliness. The strength of this partiality might be measured in part, for example, by the physical effort they exert by consistently and promptly cleaning their kitchen following meal preparation activities. If this person were looking for lawn care services, their partiality vector(s) in these regards could be used to identify lawn care services who make representations and/or who have a trustworthy reputation or record for doing a good job of cleaning up the debris that results when mowing a lawn. This person, in turn, will likely appreciate the reduced effort on their part required to locate such a service that can meaningfully contribute to their desired order.

These teachings can be leveraged in any number of other useful ways. As one example in these regards, various sensors and other inputs can serve to provide automatic updates regarding the events of a given person's day. By one approach, at least some of this information can serve to help inform the development of the aforementioned partiality vectors for such a person. At the same time, such information can help to build a view of a normal day for this particular person. That baseline information can then help detect when this person's day is going experientially awry (i.e., when their desired "order" is off track). Upon detecting such circumstances these teachings will accommodate employing the partiality and product vectors for such a person to help make suggestions (for example, for particular products or services) to help correct the day's order and/or to even effect automatically-engaged actions to correct the person's experienced order.

When this person's partiality (or relevant partialities) are based upon a particular aspiration, restoring (or otherwise contributing to) order to their situation could include, for example, identifying the order that would be needed for this person to achieve that aspiration. Upon detecting, (for example, based upon purchases, social media, or other relevant inputs) that this person is aspirating to be a gourmet chef, these teachings can provide for plotting a solution that would begin providing/offering additional products/services that would help this person move along a path of increasing how they order their lives towards being a gourmet chef.

By one approach, these teachings will accommodate presenting the consumer with choices that correspond to solutions that are intended and serve to test the true conviction of the consumer as to a particular aspiration. The reaction of the consumer to such test solutions can then further inform the system as to the confidence level that this consumer holds a particular aspiration with some genuine conviction. In particular, and as one example, that confidence can in turn influence the degree and/or direction of the consumer value vector(s) in the direction of that confirmed aspiration.

All the above approaches are informed by the constraints the value space places on individuals so that they follow the path of least perceived effort to order their lives to accord with their values which results in partialities. People generally order their lives consistently unless and until their belief system is acted upon by the force of a new trusted value proposition. The present teachings are uniquely able to identify, quantify, and leverage the many aspects that collectively inform and define such belief systems.

A person's preferences can emerge from a perception that a product or service removes effort to order their lives according to their values. The present teachings acknowledge and even leverage that it is possible to have a preference for a product or service that a person has never heard of before in that, as soon as the person perceives how it will make their lives easier they will prefer it. Most predictive analytics that use preferences are trying to predict a decision the customer is likely to make. The present teachings are directed to calculating a reduced effort solution that can/will inherently and innately be something to which the person is partial.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

This application is related to, and incorporates herein by reference in its entirety, each of the following U.S. applications listed as follows by application number and filing date: 62/323,026 filed Apr. 15, 2016; 62/341,993 filed May 26, 2016; 62/348,444 filed Jun. 10, 2016; 62/350,312 filed Jun. 15, 2016; 62/350,315 filed Jun. 15, 2016; 62/351,467 filed Jun. 17, 2016; 62/351,463 filed Jun. 17, 2016; 62/352,858 filed Jun. 21, 2016; 62/356,387 filed Jun. 29, 2016; 62/356,374 filed Jun. 29, 2016; 62/356,439 filed Jun. 29, 2016; 62/356,375 filed Jun. 29, 2016; 62/358,287 filed Jul. 5, 2016; 62/360,356 filed Jul. 9, 2016; 62/360,629 filed Jul. 11, 2016; 62/365,047 filed Jul. 21, 2016; 62/367,299 filed Jul. 27, 2016; 62/370,853 filed Aug. 4, 2016; 62/370,848 filed Aug. 4, 2016; 62/377,298 filed Aug. 19, 2016; 62/377,113 filed Aug. 19, 2016; 62/380,036 filed Aug. 26, 2016; 62/381,793 filed Aug. 31, 2016; 62/395,053 filed Sep. 15, 2016; 62/397,455 filed Sep. 21, 2016; 62/400,302 filed Sep. 27, 2016; 62/402,068 filed Sep. 30, 2016; 62/402,164 filed Sep. 30, 2016; 62/402,195 filed Sep. 30, 2016; 62/402,651 filed Sep. 30, 2016; 62/402,692 filed Sep. 30, 2016; 62/402,711 filed Sep. 30, 2016; 62/406,487 filed Oct. 11, 2016; 62/408,736 filed Oct. 15, 2016; 62/409,008 filed Oct. 17, 2016; 62/410,155 filed Oct. 19, 2016; 62/413,312 filed Oct. 26, 2016; 62/413,304 filed Oct. 26, 2016; 62/413,487 filed Oct. 27, 2016; 62/422,837 filed Nov. 16, 2016; 62/423,906 filed Nov. 18, 2016; 62/424,661 filed Nov. 21, 2016; 62/427,478 filed Nov. 29, 2016; 62/436,842 filed Dec. 20, 2016; 62/436,885 filed Dec. 20, 2016; 62/436,791 filed Dec. 20, 2016; 62/439,526 filed Dec. 28, 2016; 62/442,631 filed Jan. 5, 2017; 62/445,552 filed Jan. 12, 2017; 62/463,103 filed Feb. 24, 2017; 62/465,932 filed Mar. 2, 2017; 62/467,546 filed Mar. 6, 2017; 62/467,968 filed Mar. 7, 2017; 62/467,999 filed Mar. 7, 2017; 62/471,089 filed Mar. 14, 2017; 62/471,804 filed Mar. 15, 2017; 62/471,830 filed Mar. 15, 2017; 62/479,106 filed Mar. 30, 2017; 62/479,525 filed Mar. 31, 2017; 62/480,733 filed Apr. 3, 2017; 62/482,863 filed Apr. 7, 2017; 62/482,855 filed Apr. 7, 2017; 62/485,045 filed Apr. 13, 2017; Ser. No. 15/487,760 filed Apr. 14, 2017; Ser. No. 15/487,538 filed Apr. 14, 2017; Ser. No. 15/487,775 filed Apr. 14, 2017; Ser. No. 15/488,107 filed Apr. 14, 2017; Ser. No. 15/488,015 filed Apr. 14, 2017; Ser. No. 15/487,728 filed Apr. 14, 2017; Ser. No. 15/487,882 filed Apr. 14, 2017; Ser. No. 15/487,826 filed Apr. 14, 2017; Ser. No. 15/487,792 filed Apr. 14, 2017; Ser. No. 15/488,004 filed Apr. 14, 2017; Ser. No. 15/487,894 filed Apr. 14, 2017; 62/486,801 filed Apr. 18, 2017; 62/491,455 filed Apr. 28, 2017; 62/502,870 filed May 8, 2017; 62/510,322 filed May 24, 2017; 62/510,317 filed May 24, 2017; Ser. No. 15/606,602 filed May 26, 2017; 62/511,559 filed May 26, 2017; 62/513,490 filed Jun. 1, 2017; 62/515,675 filed Jun. 6, 2017; Ser. No. 15/624,030 filed Jun. 15, 2017; Ser. No. 15/625,599 filed Jun. 16, 2017; Ser. No. 15/628,282 filed Jun. 20, 2017; 62/523,148 filed Jun. 21, 2017; 62/525,304 filed Jun. 27, 2017; Ser. No. 15/634,862 filed Jun. 27, 2017; 62/527,445 filed Jun. 30, 2017; Ser. No. 15/655,339 filed Jul. 20, 2017; Ser. No. 15/669,546 filed Aug. 4, 2017; and 62/542,664 filed Aug. 8, 2017; 62/542,896 filed Aug. 9, 2017; Ser. No. 15/678,608 filed Aug. 16, 2017; 62/548,503 filed Aug. 22, 2017; 62/549,484 filed Aug. 24, 2017; Ser. No. 15/685,981 filed Aug. 24, 2017; 62/558,420 filed Sep. 14, 2017; Ser. No. 15/704,878 filed Sep. 14, 2017; 62/559,128 filed Sep. 15, 2017; Ser. No. 15/783,787 filed Oct. 13, 2017; Ser. No. 15/783,929 filed Oct. 13, 2017; Ser. No. 15/783,825 filed Oct. 13, 2017; Ser. No. 15/783,551 filed Oct. 13, 2017; Ser. No. 15/783,645 filed Oct. 13, 2017; Ser. No. 15/782,555 filed Oct. 13, 2017; Ser. No. 15/782,509 filed Oct. 13, 2017; 62/571,867 filed Oct. 13, 2017; Ser. No. 15/783,668 filed Oct. 13, 2017; Ser. No. 15/783,960 filed Oct. 13, 2017; and Ser. No. 15/782,559 filed Oct. 13, 2017.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

In some embodiments, an apparatus comprises one or more sensors, the one or more sensors configured to monitor parameters associated with a person and the person's home, and a control circuit, the control circuit communicatively coupled to the one or more sensors and configured to generate one or more partiality vectors for the person, wherein the one or more partiality vectors have at least one of a magnitude and an angle that corresponds to a magnitude of the person's belief in an amount of good that comes from an order associated with that partiality, receive, from the one or more sensors, values associated with the parameters, create, based on the values associated with the parameters, a spectral profile for the person, determine, based on the spectral profile and a routine experiential base state for the person, that a combination of the values indicates a deviation, and update, based on the deviation, at least one of the one or more partiality vectors for the person.

In some embodiments, a method comprises monitoring, via one or more sensors, parameters associated with a person and the person's home, generating, by a control circuit, one or more partiality vectors for the person, wherein the one or more partiality vectors have at least one of a magnitude and an angle that corresponds to a magnitude of the person's belief in an amount of good that comes from an order associated with that partiality, receiving, at the control circuit from the one or more sensors, values associated with the parameters, creating, based on the values associated with the parameters, a spectral profile for the person, determining, based on the spectral profile and a routine experiential base state for the person, that a combination of the values indicates a deviation, an updating, based on the deviation, at least one of the one or more partiality vectors for the person.

The invention claimed is:

1. An apparatus for monitoring parameters associated with a person and the person's home, the apparatus comprising:

one or more sensors, the one or more sensors configured to monitor the parameters associated with the person and the person's home; and a control circuit, the control circuit communicatively coupled to the one or more sensors and configured to:

generate one or more partiality vectors for the person, wherein the one or more partiality vectors have at least one of a magnitude and an angle that corresponds to a magnitude of the person's belief in an amount of good that comes from an order associated with that partiality;

receive, from the one or more sensors, values associated with the parameters;

create, based on the values associated with the parameters, a spectral profile for the person;

determine, based on the spectral profile and a routine experiential base state for the person, that a combination of the values indicates a deviation from the routine experiential base state for the person; and update, based on the deviation, at least one of the one or more partiality vectors for the person.

2. The apparatus of claim 1, wherein the combination of the values includes two or more of the values.

3. The apparatus of claim 2, wherein each of the two or more of the values is not out of range.

4. The apparatus of claim 1, wherein the alert is based on a magnitude with which the values vary from an expected value.

5. The apparatus of claim 1, wherein the one or more sensors include at least one of a pedometer, a motion sensor, a location sensor, a heart rate sensor, an image sensor, a noise sensor, a light sensor, a weight sensor, an activity sensor, a usage sensor, door sensors, an accelerometer, and a blood pressure sensor.

6. The apparatus of claim 1, wherein the control circuit is further configured to:

determine, based on the deviation, an alert; and cause the alert to be transmitted.

7. The apparatus of claim 6, wherein alert is transmitted to one or more of a family member, a friend, the person, an emergency service, and a retailer.

8. The apparatus of claim 6, wherein the alert includes one or more of a voice call, a text message, an email, a page, a social media message, an instant message, and a product shipment.

9. The apparatus of claim 1, wherein the one or more parameters are associated with at least one of food products in the person's home, appliance usage in the person's home, activity of the person, activity within the person's home, health information for the person, and utility usage within the person's home.

10. The apparatus of claim 1, wherein at least some of the one or more sensors are located in the person's home.

11. A method for monitoring parameters associated with a person and the person's home, the method comprising:

monitoring, via one or more sensors, the parameters associated with the person and the person's home;

generating one or more partiality vectors for the person, wherein the one or more partiality vectors have at least one of a magnitude and an angle that corresponds to a magnitude of the person's belief in an amount of good that comes from an order associated with that partiality;

receiving, at a control circuit from the one or more sensors, values associated with the parameters;

creating, based on the values associated with the parameters, a spectral profile for the person;

determining, based on the spectral profile and a routine experiential base state for the person, that a combination of the values indicates a deviation from the routine experiential base state for the person; and update, based on the deviation, at least one of the one or more partiality vectors for the person.

12. The method of claim 11, wherein the combination of the values includes two or more of the values.

13. The method of claim 12, wherein each of the two or more of the values is not out of range.

14. The method of claim 11, wherein the alert is based on a magnitude with which the values vary from an expected value.

15. The method of claim 11, wherein the one or more sensors includes at least one of a pedometer, a motion sensor, a location sensor, a hear rate sensor, an image sensor, a noise sensor, a light sensor, a weight sensor, an activity sensor, a usage sensor, door sensors, an accelerometer, and a blood pressure sensor.

16. The method of claim 11, further comprising:

determining, based on the deviation, an alert; and causing transmission of the alert.

17. The method of claim 16, wherein the alert is transmitted to one or more of a family member, a friend, the person, an emergency service, and a retailer.

18. The method of claim 17, wherein the alert includes one or more of a voice call, a text message, and email, a page, a social media message, an instant message, and a product shipment.

19. The method of claim 11, wherein the one or more parameters are associated with at least one of food products in the person's home, appliance usage in the person's home, activity of the person, activity within the person's home, health information for the person, and utility usage within the person's home.

20. The method of claim 11, wherein at least some of the one or more sensors are located in the person's home.

* * * * *